US005576737A

United States Patent [19]

Isozaki

[11] Patent Number: 5,576,737

[45] Date of Patent: Nov. 19, 1996

[54] LIQUID CRYSTAL DRIVE DEVICE, LIQUID CRYSTAL DISPLAY DEVICE, AND LIQUID CRYSTAL DRIVE METHOD

[75] Inventor: Shingo Isozaki, Suwa, Japan

[73] Assignee: Seiko Epson Corporation, Tokyo, Japan

[21] Appl. No.: 358,384

[22] Filed: Dec. 19, 1994

[30] Foreign Application Priority Data

Dec. 22, 1993 [JP] Japan ..... 5-325169

[51] Int. Cl.[6] ..... G09G 5/00

[52] U.S. Cl. ..... 345/211; 345/212; 345/210

[58] Field of Search ..... 345/87, 94, 95, 345/211, 212, 105, 103, 210

[56] References Cited

U.S. PATENT DOCUMENTS

| | | | |
|---|---|---|---|
| 3,947,721 | 3/1976 | Sue Nami et al. | 345/87 |
| 4,139,278 | 2/1979 | Matsumoto et al. | 345/94 |
| 4,414,545 | 11/1983 | Sakurada et al. | 345/87 |
| 4,432,610 | 2/1984 | Kobayashi et al. | 345/87 |
| 4,516,120 | 5/1985 | Sakuyama | 345/212 |
| 4,816,816 | 3/1989 | Usui | 345/94 |
| 4,848,876 | 7/1989 | Yamakawa | 345/87 |
| 4,901,066 | 2/1990 | Kobayashi et al. | 345/94 |
| 5,041,823 | 8/1991 | Johnson et al. | 345/94 |
| 5,065,148 | 11/1991 | Yee-Kwong | 345/87 |
| 5,066,945 | 11/1991 | Kanno et al. | 345/94 |
| 5,105,187 | 4/1992 | Plus et al. | 345/212 |
| 5,130,703 | 7/1992 | Fairbanks et al. | 345/211 |
| 5,218,352 | 6/1993 | Endoh et al. | 345/87 |
| 5,233,446 | 8/1993 | Inoue et al. | 345/95 |
| 5,282,234 | 1/1994 | Murayama et al. | 345/87 |
| 5,289,173 | 2/1994 | Numad | 345/87 |
| 5,315,311 | 5/1994 | Honkala | 345/212 |
| 5,317,332 | 5/1994 | Kanno et al. | 345/94 |
| 5,404,150 | 4/1995 | Murata | 345/211 |
| 5,420,603 | 5/1995 | Tsuboyama et al. | 345/87 |
| 5,434,599 | 7/1995 | Hirai et al. | 345/94 |

OTHER PUBLICATIONS

*Patent Abstracts of Japan* Section P:P–1683 vol. 18 No. 50 p. 45, Shigeru Yamada, "Integrated Circuit for Liquid Crystal Display Drive" & JP5273940.

*Patent Abstract of Japan* Section P:P–1495 vol. 17 No. 105 p. 53, Hiroyuki Sakayori, "Power Source for Liquid Crystal Driving" & JP4294325.

*Primary Examiner*—Mark R. Powell
*Assistant Examiner*—Martin Loui
*Attorney, Agent, or Firm*—Oliff & Berridge

[57] ABSTRACT

The objectives of this invention are to improve the method of supplying power from an operating power source and thus implement a liquid crystal drive device with an internal display data storage device that consumes less power and is also larger. A signal electrode drive circuit (X driver) is made up of a low-voltage-amplitude operating portion that operates on the supply of a first power voltage group, and a high-voltage-amplitude operating portion that operates on the supply of a second power voltage group. A frame memory that stores display data is provided in the high-voltage-amplitude operating portion, with the configuration being such that the operating power source for the frame memory is supplied from the second power voltage group. The power source of the frame memory could also be supplied through a constant-voltage circuit that regulates these second power voltages, and the supply of the first and second power voltages could be switched in accordance with the state of the second power voltage supply by a power monitoring device that monitors the second power voltage group. The configuration of the present invention is particularly effective for the multiple line selection drive method.

39 Claims, 15 Drawing Sheets

F
Δt

Y1

Y2

X1

Y1 - X1

| NUMBER OF MISMATCHES | SIGNAL ELECTRODE DATA PATTERN | NUMBER OF DATA PATTERNS | OUTPUT VOLTAGE OF X DRIVER |
|---|---|---|---|
| C = 0 | (1,1,1) | 1 | $-V_3$ |
| C = 1 | (0,1,1) (1,0,1) (1,1,0) | 3 | $-V_2$ |
| C = 2 | (1,0,0) (0,1,0) (0,0,1) | 3 | $V_2$ |
| C = 3 | (0,0,0) | 1 | $V_3$ |

LIQUID CRYSTAL DRIVE DEVICE, LIQUID CRYSTAL DISPLAY DEVICE, AND LIQUID CRYSTAL DRIVE METHOD

BACKGROUND OF THE INVENTION

1. Technical Field

This invention relates to improvements in a signal electrode driver with internal RAM that is used in a liquid crystal display device.

2. Background Art

A known prior art method of transferring display data from a microprocessor unit (MPU) to a single electrode drive circuit (X driver) in a liquid crystal display module (liquid crystal panel or LCD panel) in a simple matrix type of liquid crystal display device uses an X driver with internal RAM. With this method, the display data is sequentially transferred to the X driver by a shift clock, and this display data is temporarily written to the internal RAM. The display operation is performed by simultaneously reading out the display data for one scan line. With this method, display data is stored in the internal RAM of the X driver. Therefore, if there are no changes in the display, the display can be refreshed by reading out the display data from the internal RAM without having to transfer new display data to the X driver. This makes it unnecessary to transfer display data by the shift clock when there are no changes in the display, enabling low-power operation.

An example of the configuration of a prior art X driver with internal RAM is shown in FIG. 14. This X driver comprises a row address counter decoder 904, a timing circuit 906, a data input control circuit 908, a chip enable control circuit 910, a bidirectional shift register 912, data register 914, a frame memory (internal RAM) 916, a latch circuit 918, a level shifter 920, and a voltage selector 922. The row address counter decoder 904 functions to sequentially select one line at a time from the frame memory 916. Initialization of the selection address is based on a YD signal, and the selection address is incremented when data write to the frame memory 916 ends after the falling edge of an LP signal. The timing circuit 906 has various functions, such as control of the row address counter decoder 904 on the basis of a shift clock XSCL. The data input control circuit 908 fetches display data $D_0$ to $D_n$ from the MPU and transfers the fetched data to the data register 914. The chip enable control circuit 910 implements automatic power-saving for individual chips, when a plurality of chips are used, on the basis of enable signals CEI and CEO. The bidirectional shift register 912 outputs a control signal to the data register 914 for writing display data $D_0$ to $D_n$ to the data register 914. The order in which the display data is fetched to the data register 914 is inverted by an SHL signal. The data register 914 controls the writing of the display data to the frame memory 916, and data is written to the frame memory 916 at the falling edge of the LP signal.

The latch circuit 918 reads from the frame memory 916 display data for the row address selected by the row address counter decoder 904 at the falling edge of the LP signal, and outputs it to the level shifter 920. The level shifter 920 is a circuit for converting the voltage levels of signals from a logical power voltage level ($V_{DD}$ or $V_{SS}$) to a power voltage level for the liquid crystal drive ($V_o$ to $V_s$). The voltage selector 922 functions to select from voltages $V_o$ to $V_s$ for driving signal electrodes $X_1$ to $X_m$. The selection of one of $V_o$ to $V_s$ is determined by the display data and the FR signal which acts as a signal for alternating liquid crystal drive.

In the above described example of the prior art, the row address counter decoder 904, the timing circuit 906, the data input control circuit 908, the chip enable control circuit 910, the bidirectional shift register 912, the data register 914, the frame memory (internal RAM) 916, and the latch circuit 918 are located in a low-voltage-amplitude operating portion 901, as shown in FIG. 14, and the level shifter 920 and the voltage selector 922 are located in a high-voltage-amplitude operating portion 902. A voltage difference between a power voltage on a high-potential side and a power voltage on a low-potential side within the low-voltage-amplitude operating portion 901 is small, but a voltage difference between a power voltage on a high-potential side and a power voltage on a low-potential side within the high-voltage-amplitude operating portion 902 is large.

With this prior art example, the size of the RAM (the frame memory 916) in the X driver increases as the size of the LCD panel increases, so that the chip area would also increase if nothing further were done. In order to prevent any increase in the chip area, the use of a high-resistance type of RAM has been considered as the internal RAM, instead of a full-CMOS type of RAM. A full-CMOS type of RAM cell comprises a p-channel transistor and an n-channel transistor, but a high-resistance type of RAM cell comprises a high-resistance element and an n-channel transistor. Since there is no p-channel transistor within each RAM cell in the high-resistance type of RAM, there is no need to provide the element separation that would be necessary between a p-channel transistor and an n-channel transistor, which leads to a huge reduction in area. Thus, in order to reduce the chip area and lower the cost of the device, it is preferable to use a high-resistance type of RAM as the internal RAM.

In order to ensure that a liquid crystal drive device can be used in a liquid crystal display device in equipment such as portable electronic appliances, it is also preferable that power consumptions are reduced, and thus there is a tendency to reduce the power voltages that are used. This means that further decreases in the power voltages of the low-voltage-amplitude operating portion 901 of the X driver are continuing to be implemented. However, in order to ensure a complete lowering of these voltages, the power voltages of the internal RAM (the frame memory 916) in the low-voltage-amplitude operating portion 901 of the X driver must be reduced.

While on the one hand it is necessary to employ a high-resistance type of RAM as the internal RAM in order to enable reductions in chip area, the problem arises that the power voltages of the internal RAM must also be reduced in order to reduce the power voltages of the low-voltage-amplitude operating portion 901 and thus enable reductions in the power consumptions of the resultant devices.

However, the high-resistance type of RAM cell has problems in that read and write errors occur if the operating power voltage is less than 3.0 V, whilst data hold errors and thus retention errors (data changing errors) occur if it is less than 1.5 V. These problems will now be discussed in detail with reference to FIG. 15.

FIG. 15 shows an example of the configuration of a high-resistance (high resistance loading) type of RAM cell. This RAM cell comprises drive n-channel transistors 801 and 802 (T1 and T2) and high-value resistors 805 and 806 (R1 and R2). These components T1, T2, R1, and R2 form a data-hold unit. This RAM cell also comprises n-channel transistors 803 and 804 (T3 and T4) used as transmission gates. The transistors T3 and T4 turn on when a word line WL 804 is high, to transfer the potentials of a bit line BL 808 and a bit line bar-BL 809 to the data-hold unit configured of components T1, T2, R1, and R2.

The basic operation of this RAM cell will now be described. For data write, the transmission gates T3 and T4 turn on and the potentials of BL and bar-BL (the inverse of BL) are transferred to the data-hold unit. At this point, if it is assumed that BL is high and bar-BL is low, the potentials of the points M1 and M2 are also high and low, respectively. If the potential of point M1 goes high, transistor T2 turns on to stabilize the potential of point M2 at low. Since the potential at point M2 is low, transistor T1 turns off, stabilizing the potential of point M1 at high. The potential of point M1 is pulled up high by the high-value resistor R1 and that of point M2 is fixed at low by the transistor T2, even if the transmission gates T3 and T4 turn off thereafter, so that the potentials of points M1 and M2 are held. This implements the data write operation. For data read, the transmission gates T3 and T4 turn on and the potentials of points M1 and M2 are transferred to BL and bar-BL. These potentials are then detected by means such as sense amplifiers, to implement the data read operation.

The description now concerns an erroneous write operation. In a write, write signals are transferred via the transmission gates T3 and T4. During this time, a state occurs in which the voltage of the write signal drops by an amount equal to the threshold voltage $V_{th}$ of the n-channel transistor of each transmission gate. If a write in which BL is high and bar-BL is low is considered, the potential at point M1 drops from high level by the amount of the threshold voltage $V_{th}$ of transistor T3. This would not cause any problem if the potential at point M1 remains at a high enough level that the transistor T2 stays on. However, the potential at point M1 drops as the operating power voltage drops, and thus the transistor T2 will no longer be kept on by the potential at point M1 if the operating power voltage falls below a predetermined voltage. As a result, even if a low level is written to point M2 by the bar-BL side, the potential of point M2 will not remain stably at low, and thus an erroneous write operation will occur.

The description now concerns an erroneous read operation. In a read, the transmission gates T3 and T4 are turned on after BL and bar-BL are pre-charged to high, before the read occurs. In this case, assume that M1 is high and M2 is low at this point. If so, the potential at point M2 rises slightly as the potential at point M1 drops by the threshold voltage $V_{th}$ of the transistor T3. As a result, the transistor T2 which was in the on state moves slightly toward the off state and, at the same time, the transistor T1 which was in the off state moves slightly toward the on state. If the operating power voltage drops, the transistor T2 moves even further toward the off state and the transistor T1 moves even further toward the on state, and this could lead to a phenomenon in which the on/off states invert, and an erroneous read operation will occur. If the operating power voltage is lowered in such a manner, the impedance balance between the loads R1 and R2 and the transistors T1 and T2 will be destroyed, and variations in the threshold voltages Vth of the transistors will greatly affect stable operation. Thus a lowering of the operating power voltage will make it difficult to ensure a wide operating margin.

There is a problem with the above prior art example in that it is not possible to satisfy demands for a smaller chip area enabled by the use of high-resistance type of RAM as well as demands for lower power consumptions of the device enabled by lowering the voltage of the low-voltage-amplitude operating portion 901.

This problem is the same as the problem that occurs with a method called the multiple line selection drive method. This multiple line selection drive method has already been described by the present applicants in Japanese Patent Application Nos. 5-515531 and 5-152533.

SUMMARY OF THE INVENTION

The present invention was devised in order to solve the above described problems and has as its objective an improvement in the method by which power is supplied to an internal display data storage means, whereby normal operation of the display data storage means is ensured while further reductions in the voltages used in the low-voltage-amplitude operating portion are implemented in a device using a type of display data storage means that can be made even smaller.

Another objective of the present invention is to improve the method by which power is supplied to an internal display data storage means, using liquid crystal drive power voltages of lower levels in a liquid crystal drive device in which a multiple line selection drive method is employed.

A further objective of the present invention is to aim for stable power voltages to be supplied to the display data storage means, when the method by which power is supplied to an internal display data storage means has been improved.

A still further objective of the present invention is to monitor for abnormal states in the supplied power voltages, and also prevent the destruction of display data stored in a display data storage means if an abnormality should occur, when the method by which power is supplied to an internal display data storage means has been improved.

In order to achieve the above objectives, a first aspect of the present invention concerns a liquid crystal drive device that comprises a low-voltage-amplitude operating portion having at least a control logic unit and operating on the supply of a first power voltage group, and a high-voltage-amplitude operating portion operating on the supply of a second power voltage group that is used to drive liquid crystal elements arranged in matrix form on a liquid crystal panel, wherein the liquid crystal drive device is characterized in that:

a voltage difference between at least one pair of power voltages included within the second power voltage group, one on a high-potential side and one on a low-potential side, is set to be greater than a voltage difference between a power voltage on a high-potential side and a power voltage on a low-potential side within the first power voltage group; and the liquid crystal drive device further comprises:

a display data storage means for storing display data for implementing an image display on the liquid crystal panel; and means for supplying the second power voltage group or a third power voltage group, which is obtained by using a power conversion means to convert the second power voltage group, as an operating power source for the display data storage means.

According to this first aspect of the present invention, the display data storage means is incorporated within the high-voltage-amplitude operating portion and its operating power is supplied from a second or third power voltage group. This means that normal operation can be ensured even with a display data storage means that would cause read and write errors if it were incorporated in the low-voltage-amplitude operating portion. On the other hand, the voltage required for the logic control unit, which operates at high speed and is incorporated in the low-voltage-amplitude operating portion, can be reduced without affecting the operating voltage of the display data storage means. This makes it possible to reduce the size of the display data storage means and also aim towards reducing the power consumption. As a result, the cost of the device can be reduced and also a liquid crystal drive device that is ideal for use in portable electronic equipment can be provided.

In a second aspect of the present invention, the display data storage means comprises a plurality of RAM cells capable of being temporarily written to and read from, and each of these RAM cells comprises at least one pair of transistors for holding data, with a high-resistance element for supplying operating current being connected to each of the transistors.

According to this second aspect of the present invention, the display data storage means is configured of an array of high-resistance RAM cells. However, even although a high-resistance type of RAM cell is used, the RAM cells are located in the high-voltage-amplitude operating portion so that the occurrence of read and write errors is prevented. The use of a high-resistance type of RAM cell enables a far greater reduction in chip area than the use of the prior art full-CMOS type of RAM cell.

In a third aspect of the present invention, the liquid crystal panel comprises a plurality of scan electrodes and a plurality of signal electrodes intersecting the scan electrodes;

the liquid crystal drive device further comprises means for latching display data that has been read out from the display data storage means; level-shifting means for converting the voltage levels of the latched display data; and voltage selection means for selecting from the second power voltage group a liquid crystal drive voltage on the basis of the display data whose voltage level has been converted and outputting the liquid crystal drive voltage to the signal electrodes; and the latch means, the level-shifting means, and the voltage selection means are located in the high-voltage-amplitude operating portion.

This third aspect of the present invention enables the principles of the present invention to be applied to a liquid crystal drive device that utilizes an amplitude selective addressing scheme (a voltage-averaging method). This means that normal operation can be ensured even with a display data storage means that would cause read and write errors if it were incorporated in the low-voltage-amplitude operating portion, and also that the voltages used by the low-voltage-amplitude operating portion can be further reduced. It should be noted that, if the principles of the present invention are applied to the amplitude selective addressing scheme, it is preferable that voltages obtained by reducing the second power voltages are supplied to components such as the display data storage means, and it is also preferable that these reduced voltages are raised to the levels of the second power voltages by a level-shifting means.

In a fourth aspect of the present invention, the liquid crystal panel comprises a plurality of scan electrodes and a plurality of signal electrodes intersecting the scan electrodes;

the liquid crystal drive device further comprises drive signal determination means for determining drive voltage information for the signal electrodes based on display data read out from the display data storage means and the voltage states of a plurality of simultaneously selected scan electrodes, means for latching the drive voltage information that is output from the drive signal determination means, and voltage selection means for selecting from the second power voltage group a liquid crystal drive voltage on the basis of the latched drive voltage information and outputting the liquid crystal drive voltage to the signal electrodes; and the drive signal determination means, the latch means, and the voltage selection means are located in the high-voltage-amplitude operating portion.

This fourth aspect of the present invention enables the principles of the present invention to be applied to a liquid crystal drive device which utilizes a multiple line selection drive method. Use of the multiple line selection drive method makes it possible to reduce the voltages in the second power voltage group to less than those used in the amplitude selective addressing scheme. Therefore, suitable power voltages can be supplied to the display data storage means without having to reduce the second power voltages. There is also no need to use high-withstand-voltage processes (high voltage LSI processes) to fabricate the display data storage means, drive signal determination means, latch means, and voltage selection means. This enables an even further reduction in the chip area.

In a fifth aspect of the present invention, the power conversion means comprises constant-voltage generation means that obtains a regulated voltage in the third power voltage group from the second power voltage group, and the display data storage means operates on the supply of the third power voltage group in which a voltage has been regulated by the constant-voltage generation means.

According to this fifth aspect of the present invention, a regulated power voltage can be supplied to the display data storage means. This prevents the stable operation of the display data storage means from being affected by variations in voltage level caused by occurrences such as the switching operation of the voltage selection means. It also prevents the loss of display data and the invalid changing of data.

A sixth aspect of the present invention comprises power monitoring means for monitoring the voltage state of the second power voltage group or the third power voltage group, wherein the power monitoring means comprises a switching means for switching the power voltage supplied to the display data storage means from a voltage of the second or third power voltage group to a voltage of the first power voltage group.

According to this sixth aspect of the present invention, if the second power source turns off, for example, this off state is detected by the power monitoring means and the power voltage supplied ,to the display data storage means is switched to the first power voltage. This makes it impossible to read or write data with respect to the display data storage means, but it enables normal holding of the data. Thus the device can be provided with a function that holds the display data.

A seventh aspect of the present invention is characterized in that the power monitoring means comprises means for externally monitoring the voltage state of the second power voltage group.

This seventh aspect of the present invention makes it possible for an external device such as an MPU to monitor the voltage state of the second power voltage group. This can prevent the MPU and others from writing useless data to the display data storage means, or prevent erroneous determination that data has been written when data write is, in fact, impossible.

In an eighth aspect of the present invention, the power monitoring means comprises means for dividing a voltage difference between a pair of power voltages within the second or third power voltage group, one on a high-potential side and one on a low-potential side, thus generating a divided voltage; means for comparing the divided voltage with a reference voltage generated from the first power voltage group; and switching means for performing an on/off operation on the basis of a comparison result from the comparison means and for switching the power voltage supplied to the display data storage means from a voltage of the second or third power voltage group to a voltage of the first power voltage group.

According to this eighth aspect of the present invention, the reference voltage is generated from the first power voltage group so that it has a constant value, regardless of the state of the second power source. The divided voltage generated by the divided-voltage generation means is changed by an occurrence such as the turning off of the second power source. Thus, the comparison means can monitor the state of the second power source by comparing the reference voltage with the divided voltage. The power voltage supplied to the display data storage means can be switched to the first voltage in answer to an output result from the comparison means. This enables the reliable supply of the first power voltage to the display data storage means when a fault occurs such as the second power source turning off.

A liquid crystal display device in accordance with a ninth aspect of the present invention comprises the above described liquid crystal drive device and a liquid crystal panel in which liquid crystal elements are arranged in matrix form.

According to this ninth aspect of the present invention, since the chip area of the liquid crystal drive device can be reduced and power consumptions can be held low, the cost and power consumption of a liquid crystal display device comprising this liquid crystal drive device can also be reduced. This means that also a liquid crystal drive device that is ideal for use in portable electronic equipment can be provided.

PREFERRED EMBODIMENTS OF THE INVENTION

Embodiments of the present invention will now be described with reference to the accompanying drawings.

FIRST EMBODIMENT

1. Configuration and Operation

Figure 1:
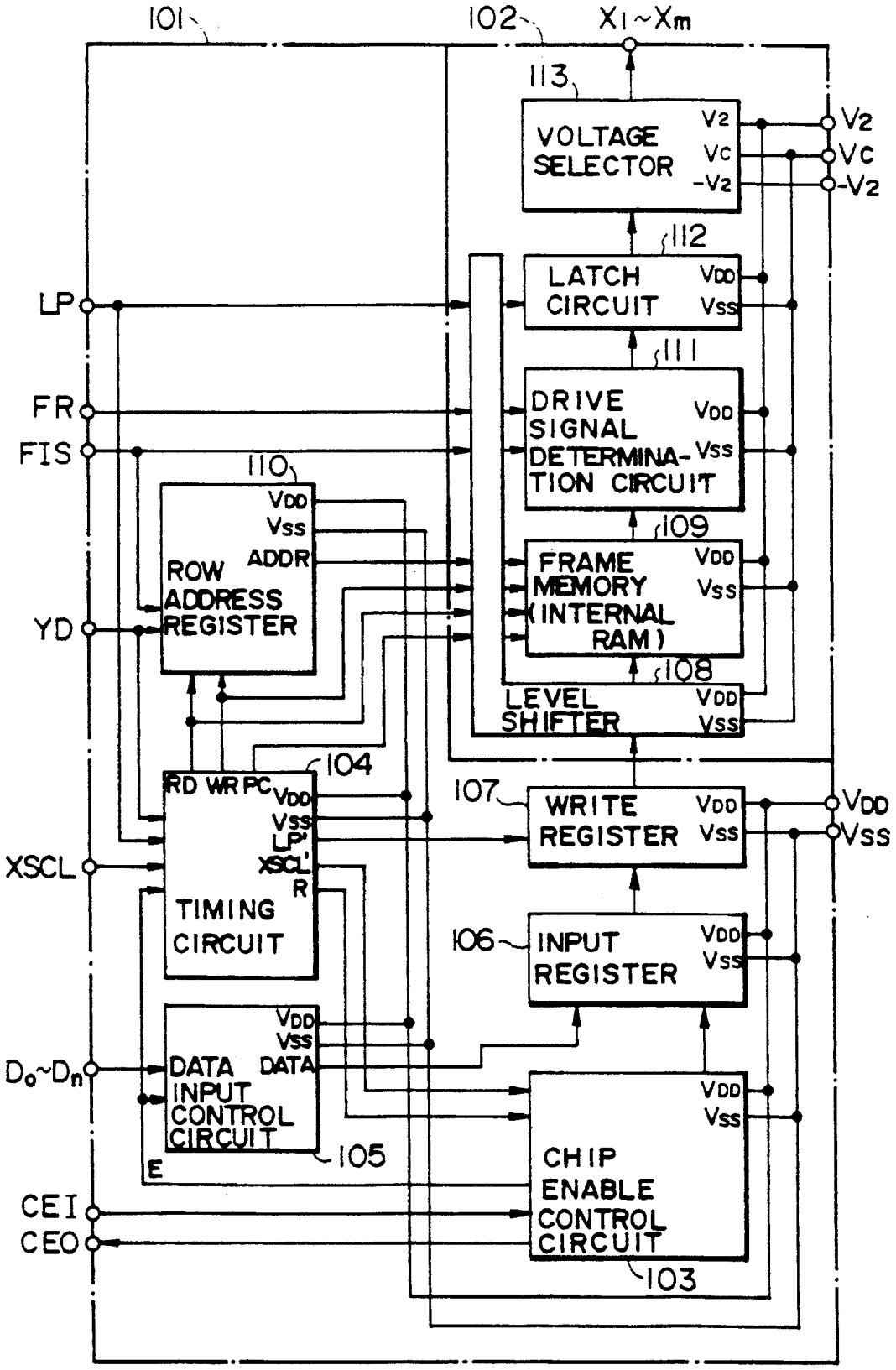
FIG. 1 is a block diagram of the entire structure of a signal electrode drive circuit (X driver) according to a first embodiment of the present invention.

A block diagram of the entire structure of a signal electrode drive circuit (X driver) according to a first embodiment of the present invention is shown in FIG. 1. The X driver of FIG. 1 is divided into a low-voltage-amplitude operating portion 101 that operates in accordance with a first power voltage group and a high-voltage-amplitude operating portion 102 that operates in accordance with a second power voltage group. A voltage difference between at least one pair of power voltages included within the second power voltage group, one on a high-potential side and one on a low-potential side, such as a voltage difference between $V_2$ and $V_C$, is set to be greater than a voltage difference between a power voltage on a high-potential side $V_{DD}$ and a power voltage on a low-potential side $V_{SS}$ within the first power voltage group.

The X driver of FIG. 1 also comprises a chip enable control circuit 103, a timing circuit 104, a data input control circuit 105, an input register 106, a write register 107, a level shifter 108, a frame memory (internal RAM) 109, a row address register 110, a drive signal determination circuit (multiple line selection decoder, or MLS decoder) 111, a latch circuit 112, and a voltage selector 113. In this embodiment, the chip enable control circuit 103 performs automatic power-saving for individual chips, when a plurality of chips are used, on the basis of enable signals CEI and CEO. The timing circuit 104 shapes necessary timing signals on the basis of a shift clock XSCL and YD and LP signals. The data input control circuit 105 fetches display data $D_0$ to $D_n$ transferred from an MPU for the X driver at the generation of an enable signal E, and outputs the fetched data to the input register 106. The input register 106 sequentially fetches the display data at the falling edges of the shift clock XSCL and holds the display data for one scan line. The write register 107 latches all the display data for one scan line at a time from the input register 106 at a latch pulse, and when, for example, two scan-lines worth of display data has been latched, it outputs that display data and writes it to memory cells in the frame memory 109, via the level shifter 108.

The level shifter 108 has the function of converting the levels of signals when they are transferred from the low-voltage-amplitude operating portion 101 to the high-voltage-amplitude operating portion 102. The frame memory 109 comprises memory cells arranged in a matrix, together with their peripheral circuitry, and accumulates display data input from the write register 107. The row address register 110 is initialized by a signal scan start signal YD and a field identification signal FIS that will be described later, and sequentially selects a line (a word line) of the frame memory 109 every time a write control signal WR or read control signal RD is applied from the timing circuit 104. This causes two lines of display data to be output from the frame memory 109 to the drive signal determination circuit 111. The drive signal determination circuit (MLS decoder) 111 determines drive voltage information for the signal electrodes based on a combination of the FIS signal, an alternation signal FR, and display data (two lines worth) from the frame memory 109. The latch circuit 112 latches all of the drive voltage information from the drive signal determination circuit 111 at the same time at the falling edge of the LP signal. The voltage selector 113 selects the liquid crystal drive voltage from a second power voltage group $V_2$, $V_C$, and $-V_2$, based on the drive voltage information from the latch circuit 112, and applies that liquid crystal drive voltage to each of signal electrodes $X_1$ to $X_m$.

Note that the latch pulse LP' and shift clock XSCL' that are output from the timing circuit 104 of FIG. 1 are created from the control signals LP and XSCL applied to the X driver, but, since these output signals are generated only with modification of the display on the LCD panel, they are distinguished from the LP and XSCL simply by an apostrophe (') suffix.

Figure 2:
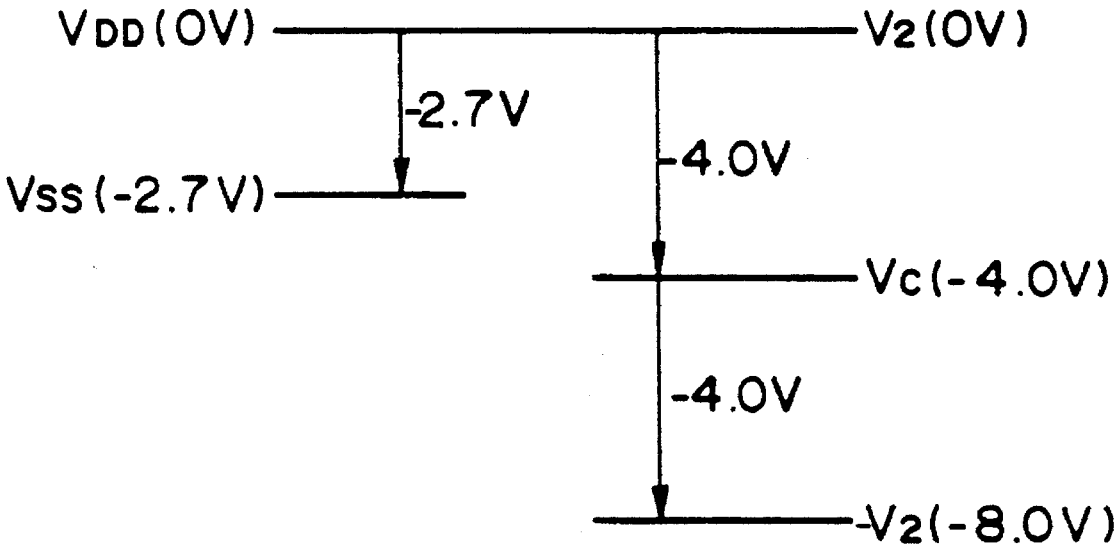
FIG. 2 is a diagram of the relationships between the potentials in a second power voltage group.

The method by which the power voltage is supplied in this embodiment will now be described. In this embodiment, a first power voltage group is supplied to the low-voltage-amplitude operating portion 101 by terminals $V_{DD}$ and $V_{SS}$, and a second power voltage group is supplied to the high-voltage-amplitude operating portion 102 by terminals $V_2$, $V_C$, and $-V_2$. The relationships between the potentials of these power source are such that $V_{DD}$ and $V_2$ act as a common potential as shown in FIG. 2. In other words, $V_{DD}$ and $V_2$ are both 0 V, $V_{88}$ is −2.7 V, $V_C$ is −4.0 V, and $-V_2$ is −8.0 V. The description of the supply of power voltages to the blocks within the X driver now returns to FIG. 1. The power terminals $V_{DD}$ and $V_{SS}$ of the blocks of the row address register 110, the timing circuit 104, the data input control circuit 105, the write register 107, the input register 106, and the chip enable control circuit 103 within the low-voltage-amplitude operating portion 101 are connected to the terminals $V_{DD}$ and $V_{SS}$ through which the first power voltage group is supplied. This means that 0 V is supplied to each $V_{DD}$ terminal and −2.7 V to each $V_{SS}$ terminal, within the low-voltage-amplitude operating portion 101. As a result, these blocks operate at a power voltage with a voltage difference of 2.7 V. Similarly, the power terminals $V_2$, $V_C$, and $-V_2$ of the voltage selector 113 in the high-voltage-amplitude operating portion 102 are connected to the terminals $V_2$, $V_C$, and $-V_2$ through which the second power voltage group is supplied. This means that 0 V is supplied to each $V_2$ terminal, −4.0 V is supplied to each $V_C$ terminal, and −8.0 V is supplied to each $-V_2$ terminal. These voltages are used to shape the outputs $X_1$ to $X_m$ of the X driver, by being selected by the voltage selector 113. The power terminals $V_{DD}$ and $V_{SS}$ of the blocks of the latch circuit 112, the drive signal determination circuit 111, the frame memory 109, and the level shifter 108 within the high-voltage-amplitude operating portion 102 are connected to the terminals $V_2$ and $V_C$ through which the second power voltage group is supplied. This means that 0 V is supplied to each $V_{DD}$ terminal and −4.0 V is supplied to each $V_{SS}$ terminal, within the high-voltage-amplitude operating portion 102. As a result, these blocks operate at a power voltage with a voltage difference of 4.0 V.

Figure 15:
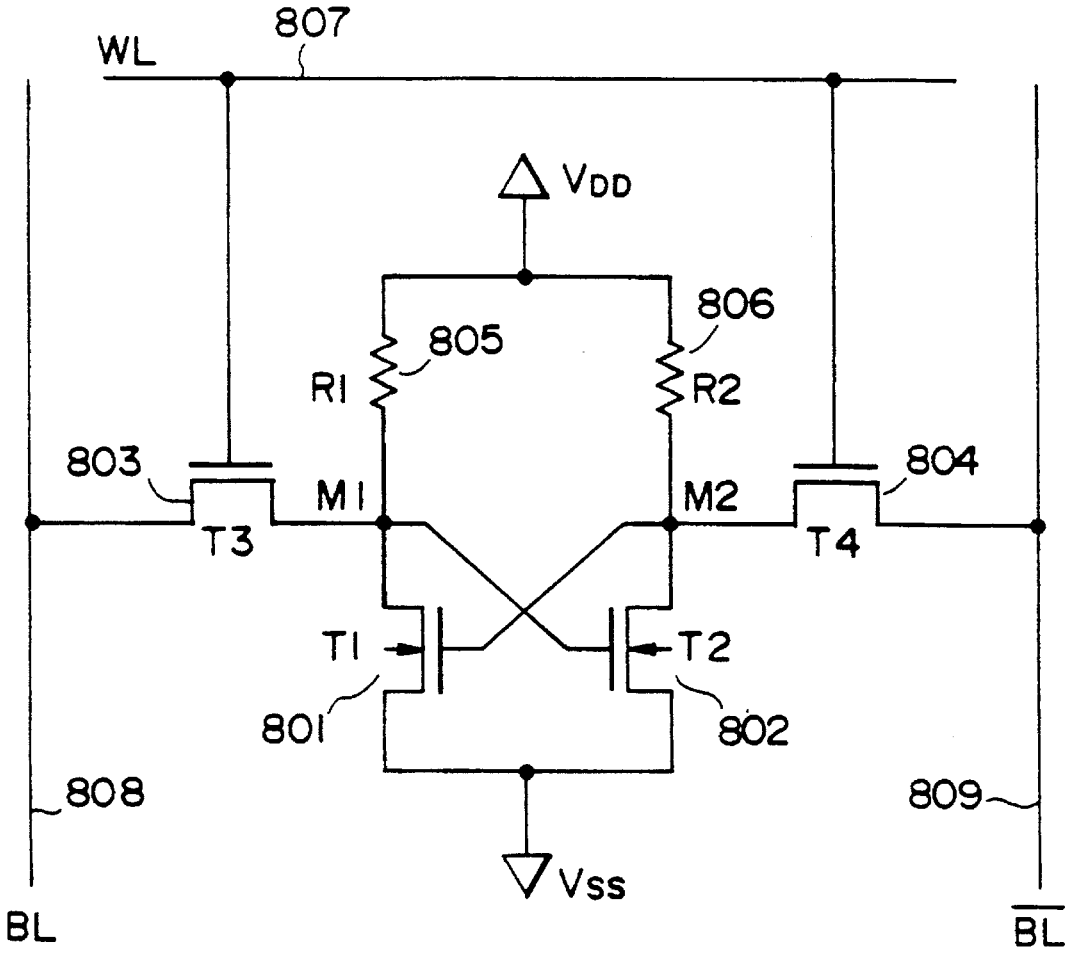
FIG. 15 is a diagram exemplifying the configuration of a high-resistance type (high resistance loading) of RAM.

As described above, a power voltage with a voltage difference of 4.0 V is supplied to the frame memory 109 in the X driver of this embodiment by the second power voltage group $V_2$ and $V_c$. This ensures that the RAM operates stably, even when the frame memory 109 is configured of a high-resistance (high resistance loading) type of RAM (see FIG. 15). Configuring the frame memory 109 of a high-resistance type of RAM leads to a reduction in chip area. In addition, there is now no need to locate the frame memory 109 in the low-voltage-amplitude operating portion 101 which comprises a logic control unit operating at high speed. This makes it possible to reduce the voltage difference of the first power voltage group supplied to the low-voltage-amplitude operating portion 101 by, for example, setting $V_{DD}$ to 0 V and $V_{as}$ to −2.7 V. Since this makes it possible to reduce the power voltage of portions operating in accordance with a high-speed clock (at, for example, a factor of m times that of the high-voltage-amplitude operating portion), power consumption can be greatly reduced. These lower voltages enable the use of finer processing to fabricate the transistors that form the low-voltage-amplitude operating portion 101, leading to an even further decrease in the chip area.

Figure 3:
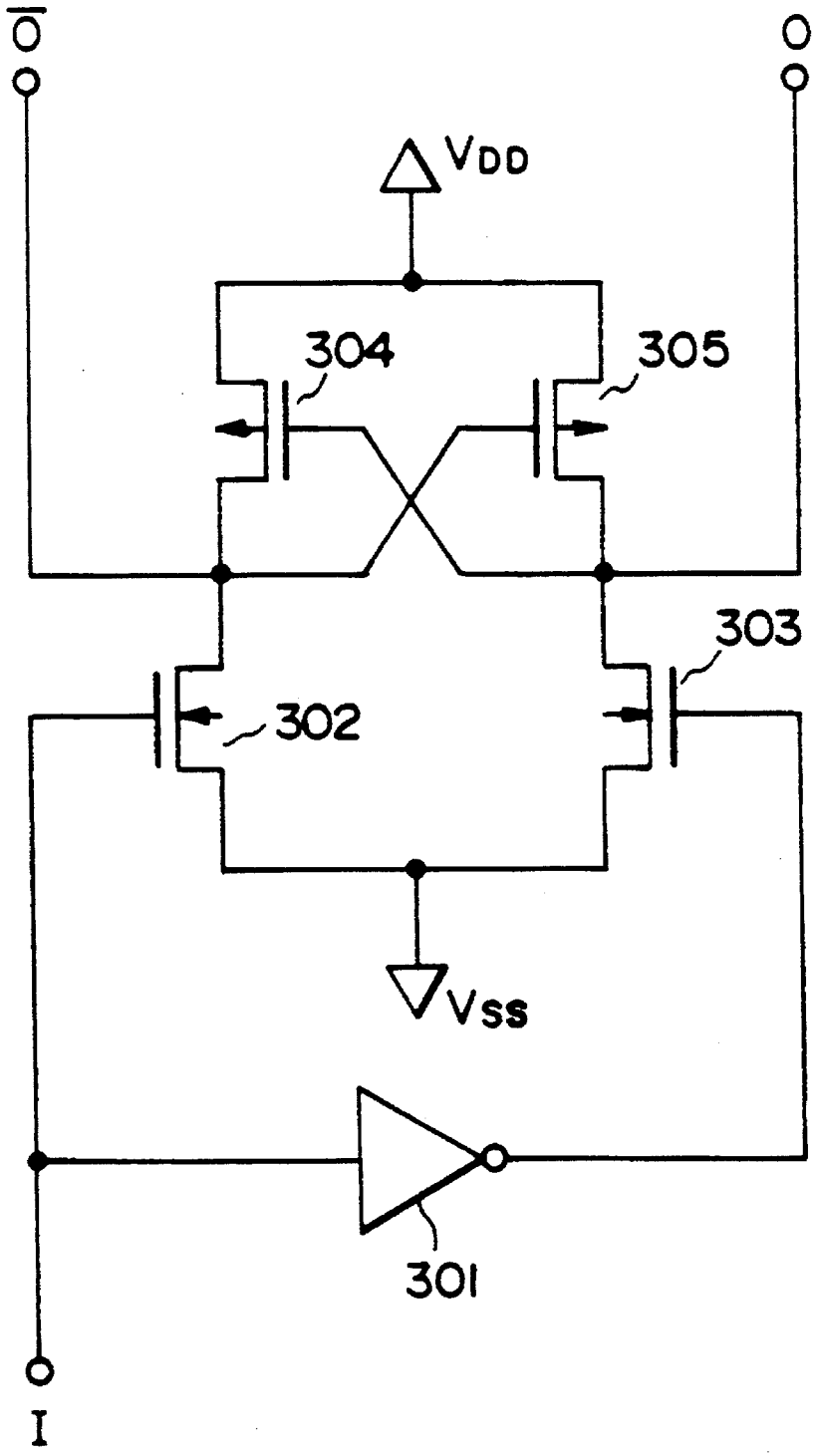
FIG. 3 is a diagram exemplifying the configuration of a level shifter.

Note, however, that this embodiment not only provides an improvement in the method by which power voltage is supplied to the frame memory 109; it also provides an improvement in the location of the level shifter 108. An example of the configuration of the level shifter 108 that converts signal levels when signals are transferred from the low-voltage-amplitude operating portion 101 to the high-voltage-amplitude operating portion 102 is shown in FIG. 3. The level shifter 108 comprises an inverter 301 that inverts an input signal I, n-channel transistors 302 and 303 that are turned on and off by the input signal I, and p-channel transistors 304 and 305 that are turned on and off in accordance with the potentials of the drain regions of the n-channel transistors 302 and 303. Power voltages $V_{DD}$ and $V_{SS}$ are supplied from the second power voltage group.

The operation of this level shifter 108 will now be described. If the input signal I goes low, for example, the voltage levels at the gate electrodes of the transistors 302 and 303 go low and high, respectively. This turns the transistor 302 off and the transistor 303 on. Therefore, the voltage level at the gate electrode of the transistor 304 goes low so that the transistor 304 turns on. Conversely, the voltage level at the gate electrode of the transistor 305 goes high so that the transistor 305 turns off. As a result, outputs O and bar-O (the inverse of O) go low and high, respectively, and the input I has its level converted and is transferred to the output O. When the input I is high, the on/off relationships of the transistors 302 and 303 and the transistors 304 and 305 are each reversed.

Figure 4:
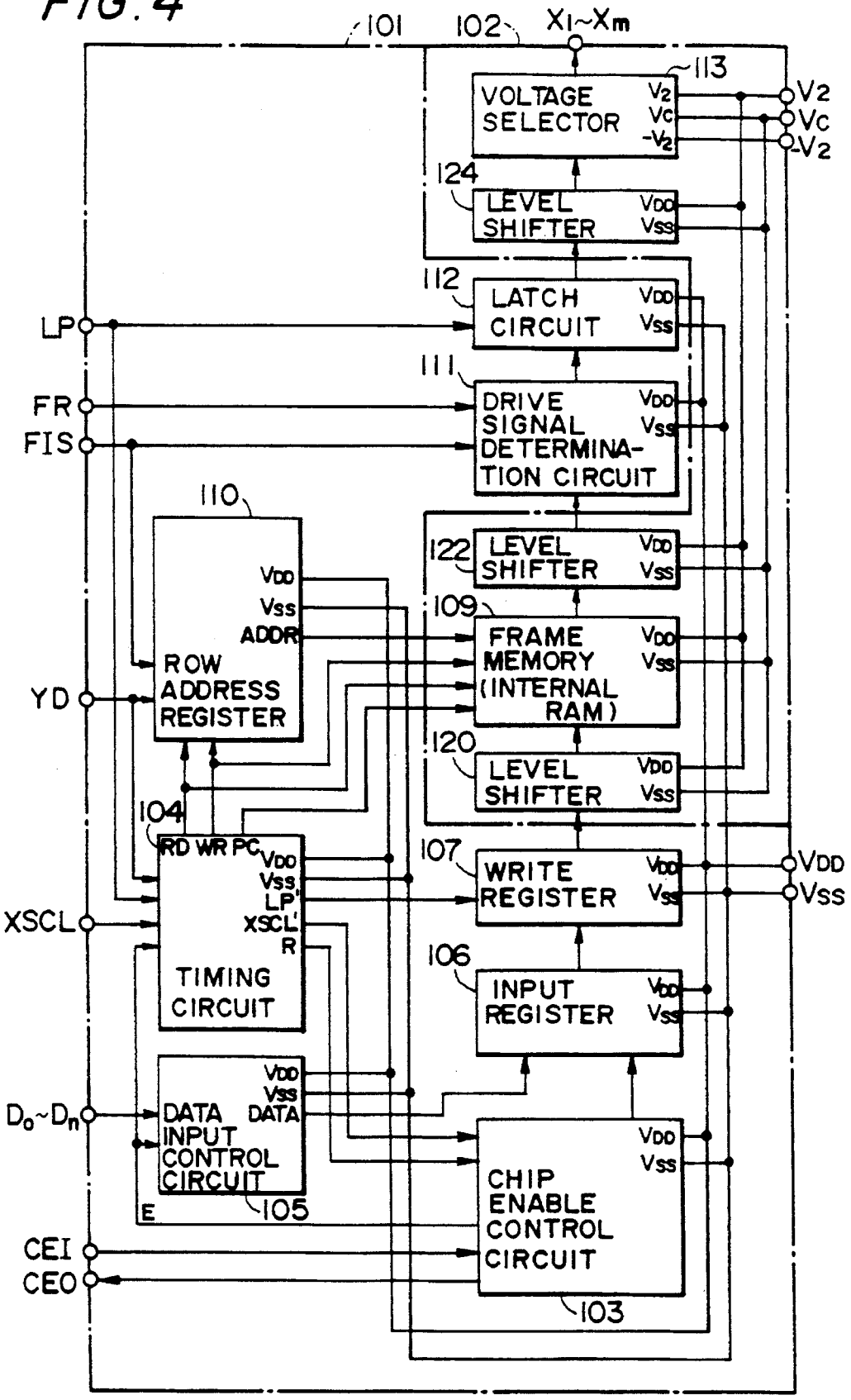
FIG. 4 is a block diagram exemplifying the configuration of the signal electrode drive circuit when the drive signal determination circuit and latch circuit of the first embodiment are located in the low-voltage-amplitude operating portion.
Figures 5A, 5B, 5C, 5D:
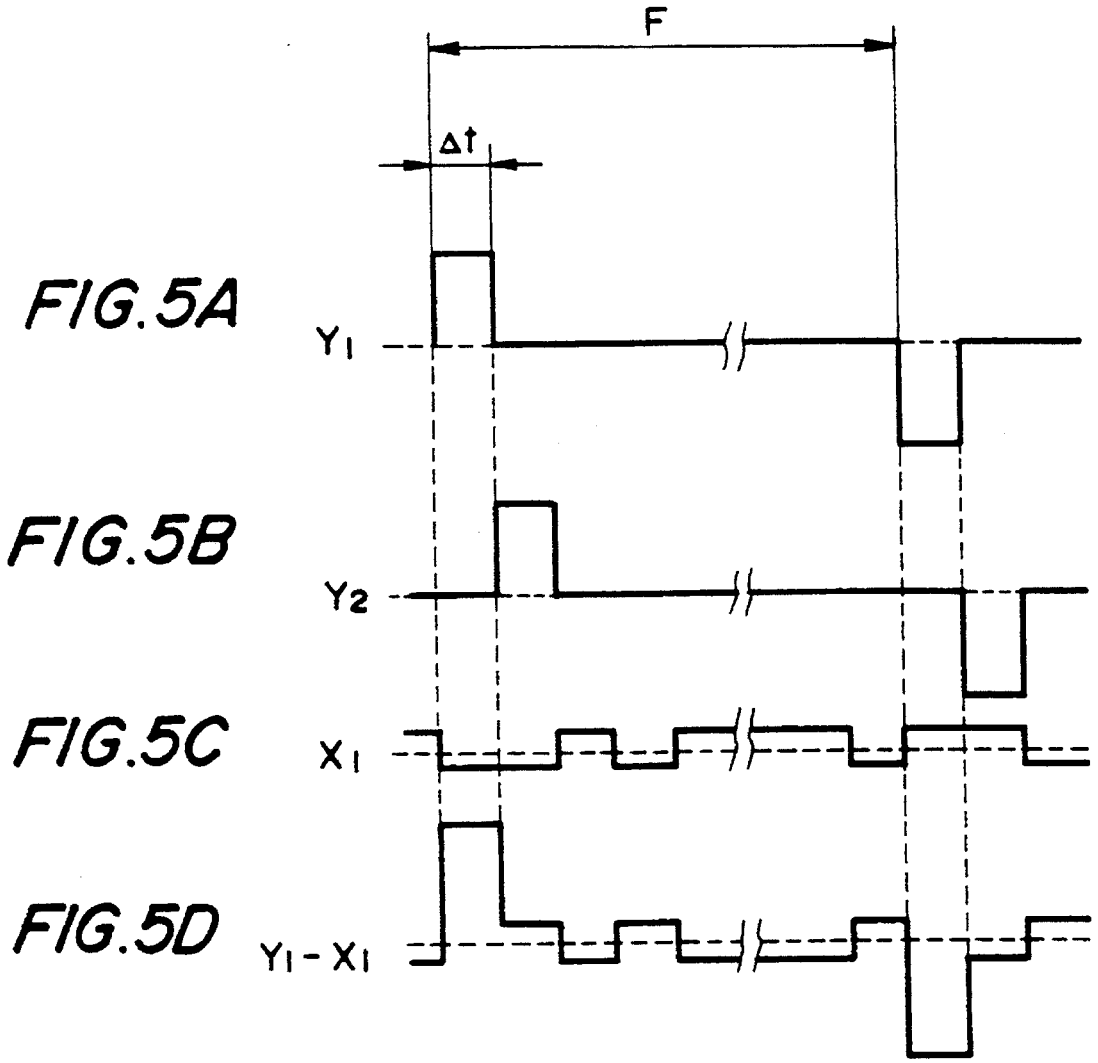
FIGS. 5A to 5D are waveform charts of the voltages applied to the scan electrodes, signal electrodes, and liquid crystal elements when an amplitude selective addressing scheme is used.

The location of the level shifter 108 of this embodiment will now be described. The latch circuit 112 and the drive signal determination circuit 111 located in the high-voltage-amplitude operating portion 102 could be located in the low-voltage-amplitude operating portion 101 as shown in FIG. 4, in which case they would operate on the first power voltage group. If the configuration is devised in such a manner that these two circuits operate at low voltages, there would be no need to convert the levels of signals LP, FR, and FIS, as shown in FIG. 4, but a disadvantage arises in that a plurality of level shifters would be required, as described below. In other words, with the example shown in FIG. 4 it is necessary to provide a level shifter 120 for increasing the level of signals transferred from the write register 107 to the frame memory 109, a level shifter 122 for decreasing the level of signals transferred from the frame memory 109 to the drive signal determination circuit 111, and a level shifter 124 for increasing the level of signals transferred from the latch circuit 112 to the voltage selector 113. Since a number of signals that equals the number of outputs (m) to the driver must pass through each of these level shifters 120, 122, and 124, the areas occupied by the level shifters is greatly increased and thus the chip area of the driver is increased. Thus, in the first embodiment, the level shifter 108 is located as shown in FIG. 1, level conversion is performed only once, and the latch circuit 112 and the drive signal determination circuit 111 are configured such that they operate at high voltages. The high-voltage-amplitude operating portion 102 does not contain any components that operate on the high-speed clock XSCL like the control logic unit within the low-voltage-amplitude operating portion 101. Therefore, this configuration will not have a large effect on the increase in the overall power consumption of the X driver.

2. Multiple Line Selection Drive Method

The X driver of this embodiment has a configuration that can be applied to the multiple line selection drive method. This multiple line selection drive method not only implements the same on/off ratio as the prior art drive method in which one line is selected at a time, it can hold down the drive voltages on the X driver side. If, for example, the threshold voltage $V_{th}$ of the liquid crystal element is 2.1 V and the duty ratio is 1/240, the maximum drive voltage amplitude, which has to be of the order of 20 V with the prior art drive method, need only be 8.0 V (between $V_2$ and $-V_2$) with the multiple line selection drive method as exemplified by this embodiment. Therefore, there is no need to form the voltage selector 113 and the level shifter 124, which are high-withstand-voltage portions, of a monolithic structure. This makes it possible to use processing capable of fabricating highly integrated RAM, and thus a large-capacity RAM can be incorporated in the X driver. In order to implement the multiple line selection drive method, a number of power voltages equal to the number of simultaneously selected lines plus one must be supplied to the voltage selector 113. In this case, since there are two simultaneously selected lines, three power voltages ($V_2$, $V_C$, and $-V_2$) are required. Since the maximum difference between any two of these power voltages is a low 8.0 V, these power voltages can be used as the operating power source for the RAM, without any reduction. In this embodiment, the voltage difference between $V_2$ and $V_C$ (4.0 V) is used as the RAM operating power source.

The multiple line selection method will now be described. In a drive method implemented by the amplitude selective addressing scheme (the voltage-averaging mehtod), scan electrodes $Y_1$ and $Y_2$ to Yn are selected one line at a time and a scan voltage is applied thereto, and also a signal electrode waveform corresponding to whether each of the pixels on each selected scan electrode is turned on or off is applied to each of signal electrodes $X_1$ and $X_2$ to $X_m$, as shown in FIGS. 5A to 5D. However, this method causes problems in that the drive voltages have to be comparatively high, and also the contrast is bad and adjustment of frame gradations causes a great deal of flickering. The multiple line selection drive method has been proposed as means of solving these problems.

Figures 6A, 6B, 6C, 6D:
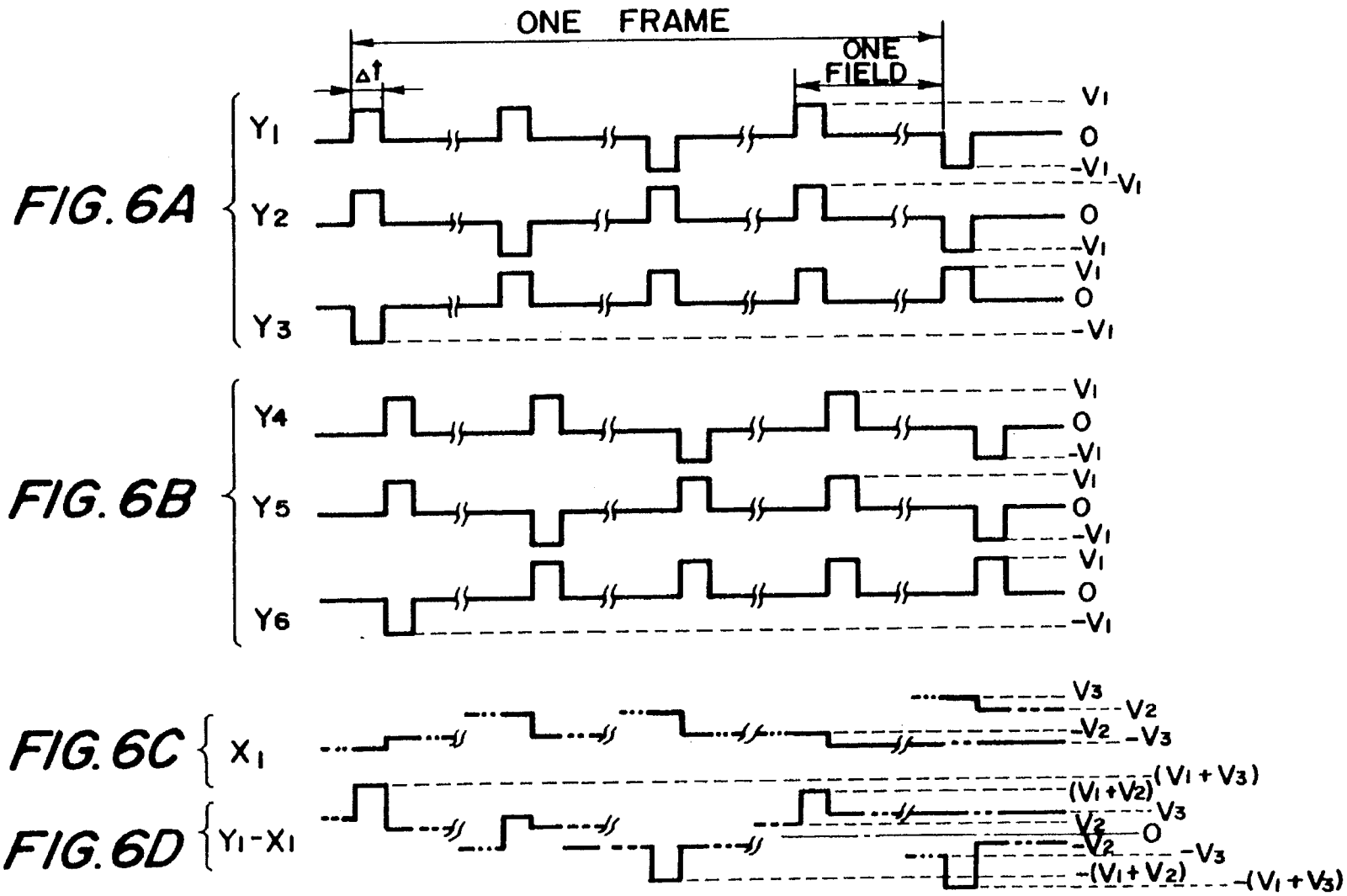
FIGS. 6A to 6D are waveform charts of the voltages applied to the scan electrodes, signal electrodes, and liquid crystal elements when a multiple line selection drive method is used.
Figures 7A, 7B:
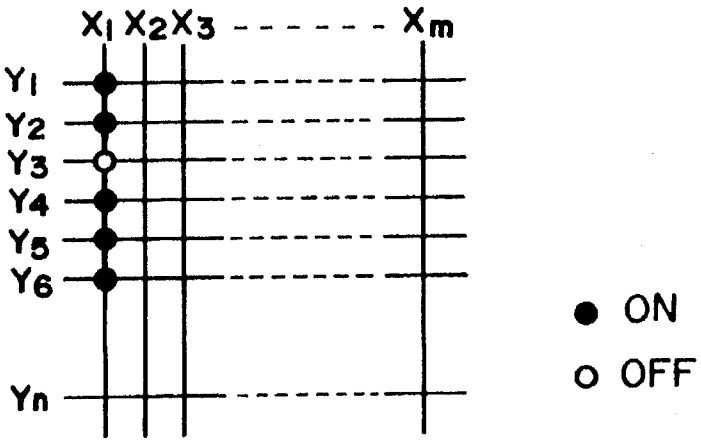
FIG. 7A is a diagram exemplifying pixel on/off states.
FIG. 7B shows the relationships between the number of mismatches, signal electrode data patterns, the number of data patterns, and the output voltage of the X driver.

An example of the voltage waveforms that are applied when the multiple line selection drive method is used is shown in FIGS. 6A to 6D. These charts show an example in which three scan electrodes at a time are simultaneously selected. If, for example, the pixel display is to be as shown in FIG. 7A, scan electrodes $Y_1$, $Y_2$, and $Y_3$ are first selected simultaneously and the scan voltages shown in FIG. 6A are applied to those scan electrodes $Y_1$, $Y_2$, and $Y_3$. Scan electrodes $Y_4$, $Y_5$, and $Y_6$ are then selected and the scan voltages shown in FIG. 6B are applied to those scan electrodes $Y_4$, $Y_5$, and $Y_6$. This simultaneous selection process continues through all of the scan electrodes $Y_1$ to Yn in sequence. The potentials are then inverted for the next frame, to provide alternating liquid crystal drive. With the multiple line selection drive method, the selection period is dispersed into equal portions time-wise within one frame while the normalized orthogonality of the selection of the scan electrodes is maintained, and thus a group of a specified number (a block) of scan electrodes are simultaneously selected. In this case, "normalized" means that all of the scan voltages have the same RMS voltage (amplitude), in frame period, and "orthogonal" means that the sum of the products of each voltage amplitude applied to a certain scan electrode with respect to the voltage amplitude applied to any other scan electrode within each selection period is zero in frame period. This normalized orthogonality is a major prerequisite for independent on/off control of each pixel in a simple matrix type of LCD. For example, if the level $V_1$ at selection in FIGS. 6A to 6D is 1 and that of $-V_1$ is $-1$, and if the determinant for one frame is $F=f_{ij}$, the orthogonality of the first row ($Y_1$) and the second row ($Y_2$) is proven to be:

$$\Sigma_{(j=1\ to\ 4)} f_{1j} \times f_{2j} = 1+(-1)+(-1)+1=0$$

As for the voltage waveforms on the signal electrode, if h electrodes are simultaneously selected, for example, one voltage level is selected from (h+1) separated voltage levels to correspond to the display data. With the amplitude selective addressing scheme, a signal electrode (row) waveform corresponds to the selection waveform for a row, in a one-to-one manner, as shown in FIGS. 5A to 5D. In contrast, when h electrodes are simultaneously selected, equivalent on/off voltage levels must be output for all of the row selection waveforms that make up the group of h electrodes. If "on" display data is 1 and "off" display data is 0, these equivalent on/off voltage levels are depends on a number of mismatches C between the signal electrode data pattern and the column pattern (the pattern of selected scan electrodes) given by the determinant $F=f_{ij}$. For example, consider the case in which the column pattern is (1, 1, 1), in which case the signal electrode data pattern and the output voltage of the X driver will be as shown in FIG. 7B. Thus, if the column pattern is determined, the output voltage of the X driver can be obtained directly by decoding the number of mismatches or the signal electrode data pattern. In other words, the drive signal determination circuit 111 obtains the drive voltage information on the basis of the signal electrode data pattern for three lines output from the frame memory 109, the FR signal, and the FIS signal, and the output voltage of the X driver is obtained on the basis of this drive voltage information. Specific signal electrode voltage waveforms are shown in FIG. 6C. If the pixels at the intersections of the signal electrodes $X_1$ and the scan electrodes $Y_1$, $Y_2$, and $Y_3$ display 1 (on), 1 (on), then 0 (off) in sequence, as shown in FIG. 7A, the voltages on the scan electrodes during the initial period $\Delta t$ are 1 ($V_1$), 1 ($V_1$), and 0 ($-V_1$) in sequence. Therefore, since the number of mismatches is zero, the output voltage for the signal electrode $X_1$ during the initial period $\Delta T$ is $-V_3$, as can be seen from FIG. 7B. The output voltage waveforms of the other signal electrodes are determined in the same manner.

The present applicants described an equal-dispersion type of multiple line selection drive method, which is an improvement on the above described multiple line selection drive method, in Japanese Patent Application No. 5-515531. This equal-dispersion type of multiple line selection drive method simultaneously selects a plurality of scan electrodes in sequence, and divides that selection period so that voltages are applied a plurality of times within one frame. In other words, each voltage is not applied once in one frame (for a total period of $h \times \Delta t$), but the selection period is divided (dispersed) into a plurality of times within one frame. Since this means that a voltage is applied a plurality of times to each pixel within one frame, contrast can be increased while brightness is maintained. In this case, the voltage application for four column patterns could be such that they are divided into four and applied one at a time, or, for example, such that the four column patterns are divided into two and voltages are applied two at a time.

Since three scan electrodes are simultaneously selected with the above described multiple line selection method, the second power voltage group has four levels: $V_3$, $V_2$, $-V_2$, and $-V_3$. If $V_{DD}$ is made equal to $V_3$ and both are 0 V, the power terminals $V_{DD}$ and $V_{SS}$ of the frame memory 109 and other components are supplied with one of the pairs of voltages $V_3$ and $V_2$, $V_3$ and $-V_2$, or $V_3$ and $-V_3$. Conversely, if $V_{SS}$ is made equal to $-V_3$ and both are 0 V, the power terminals $V_{DD}$ and $V_{SS}$ of the frame memory 109 and other components are supplied with one of the pairs of voltages $-V_2$ and $-V_3$, $V_2$ and $-V_3$, or $V_3$ and $-V_3$. In either case, the voltage difference between at least one of the pairs of voltages (for example, the voltage difference between $V_3$ and $-V_3$) is greater than the voltage difference between $V_{DD}$ and $V_{SS}$ supplied to the low-voltage-amplitude operating portion 101, and this ensures the normal operation of the frame memory 109. This principle can be extended in a similar manner to increase the second power voltage group to five or more levels when the number of simultaneously selected electrodes is four or more.

SECOND EMBODIMENT

Figure 8:
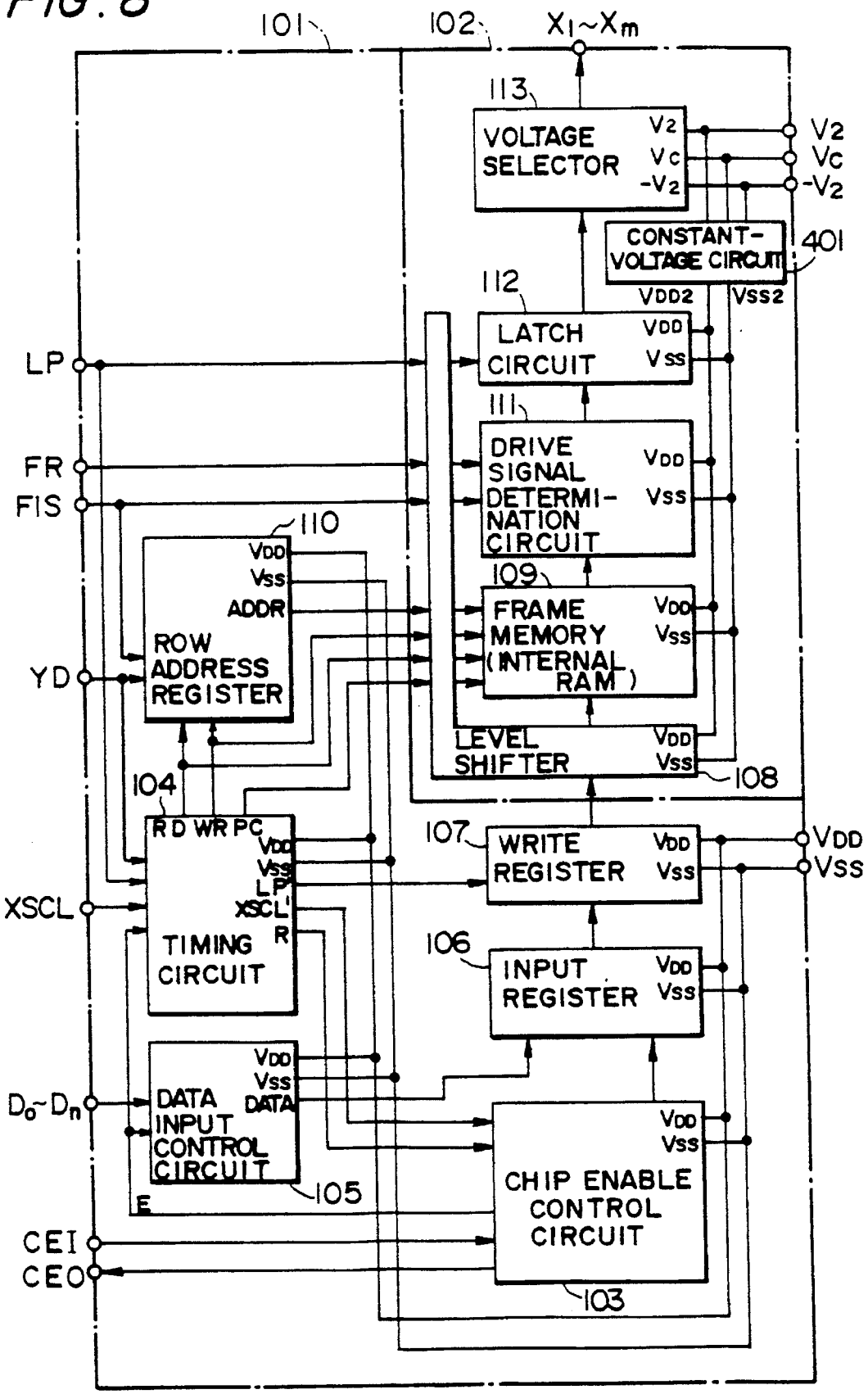
FIG. 8 is a block diagram of the entire structure of a signal electrode drive circuit according to a second embodiment of the present invention.

In the first embodiment of FIG. 1, the second power voltage group $V_2$ and $V_C$ was supplied directly to the latch circuit 112, the drive signal determination circuit 111, the frame memory 109, and the level shifter 108 of the high-voltage-amplitude operating portion 102. However, if $V_2$ and $V_C$ are supplied directly in such a manner, changes in voltage level caused by the switching of the voltage selector 113 have an effect on the stable operation of these circuits, especially that of the frame memory 109. This second embodiment was devised in consideration of this problem in such a manner that it supplies the second power voltage group to these circuits through a constant-voltage circuit instead of directly. A block diagram of the configuration of the X driver of this second embodiment is shown in FIG. 8. Structural blocks in FIG. 8 that have the same reference numbers as those in FIG. 1 are the same as those described with reference to FIG. 1. In this case, a constant-voltage circuit 401 is added. The second power voltage group $V_2$, $V_C$, and $-V_s$ is input to this constant-voltage circuit 401, and regulated voltages $V_{DD2}$ (=0 V) and $V_{SS2}$ (=−4.0 V) are generated therein and are supplied to the latch circuit 112, the drive signal determination circuit 111, the frame memory 109, and the level shifter 108. This ensures the stable operation of these circuits.

Figure 9:
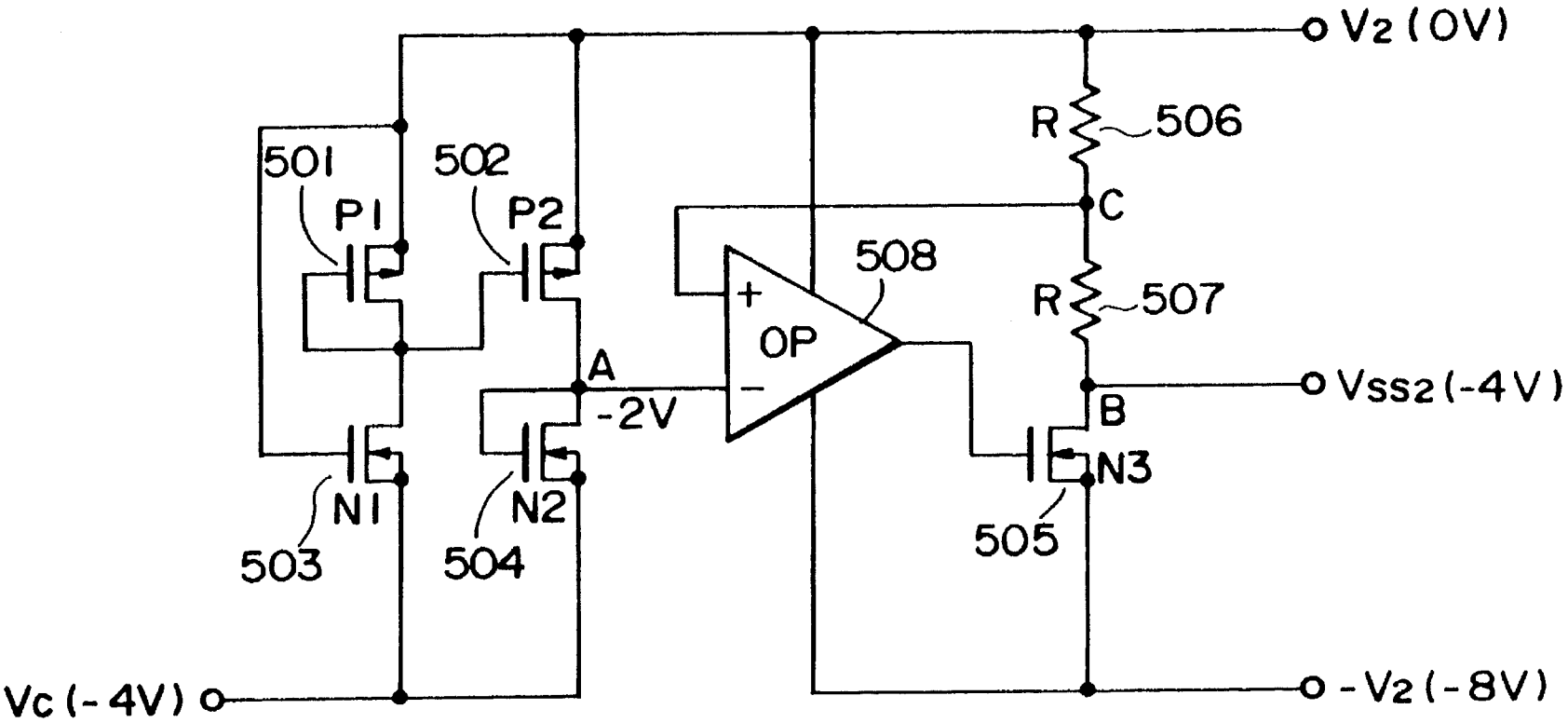
FIG. 9 is a diagram exemplifying the configuration of a constant-voltage circuit.

An example of the configuration of the constant-voltage circuit 401 is shown in FIG. 9. This constant-voltage circuit 401 comprises p-channel transistors 501 and 502 (P1 and P2), n-channel transistors 503, 504, and 505 (N1, N2, and N3), resistors 506 and 507 (R, R) of the same value, and an op amp 508 (OP).

The operation of this circuit will now be described. In a reference voltage generation section configured of components P1, P2, N1, and N2, the threshold voltages $V_{th}$ of the transistors P1 and P2 are made to be the same, and the transistor capabilities of P1 and P2 and of N1 and N2 are the same. This configuration ensures that a reference voltage ($V_{th2}-V_{th1}$) is generated at a point A. In this case, $V_{th1}$ and $V_{th2}$ are the threshold voltages of transistors N1 and N2, respectively. Assuming that $V_{th1}$ is 2.5 V and $V_{th2}$ is 0.5 V, the voltage at point A is always constant at −2.0 V, regardless of changes in $V_C$. The point A is connected to an inverting input terminal of the op amp 508. When the transistor N3 is now turned on so that a current flows through the resistors R, the voltage at point C is fixed at −2.0 V by the imaginary-short function of the op amp 508. The currents flowing through the resistors 506 and 507 are equal and the resistances of the resistors 506 and 507 are also the same. Therefore, the voltage drop across each of the resistors 506 and 507 is the same and thus the voltage at a point B becomes −4.0 V. This voltage is always constant, regardless of changes in $-V_2$. This regulated voltage is supplied to components such as the frame memory 109 as $V_{SS2}$. For $V_{DD2}$, the reference voltage $V_2$ (=0 V) is supplied as is. This ensures the stable operation of components such as the frame memory 109.

THIRD EMBODIMENT

In a liquid crystal display system, it is sometimes required to turn off the power source of the liquid crystal drive in order to reduce power consumption. For example, in a mode called "display off," all of the liquid crystal power voltages are fixed at the same voltage. If the power source of the liquid crystal drive is turned off when the X driver of the first embodiment shown in FIG. 1 or that of the second embodiment shown in FIG. 8 is used, the second power source for supply to the high-voltage-amplitude operating portion 102 is also turned off. This clears the display data stored in the frame memory 109, and thus the data is lost.

Figure 10:
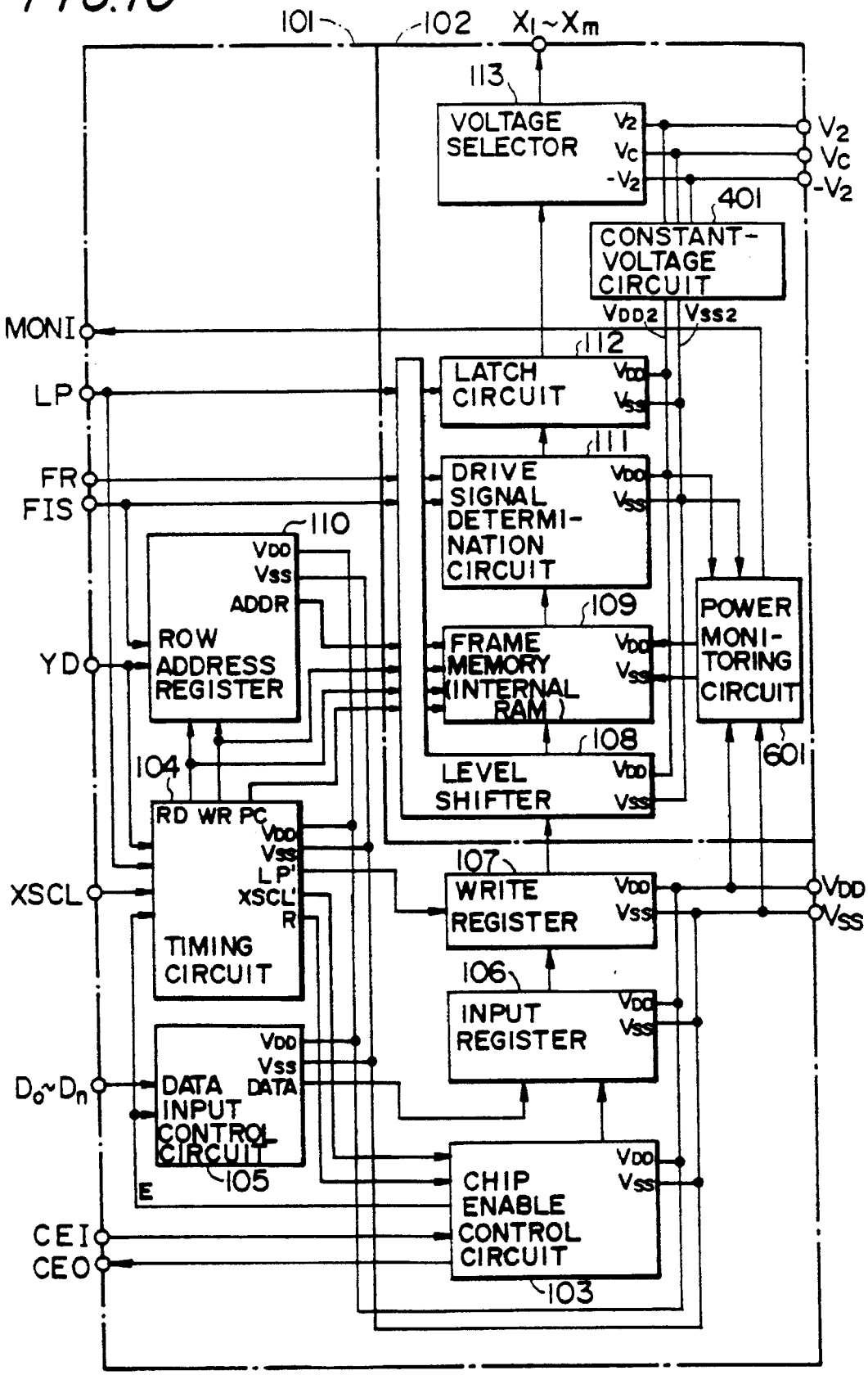
FIG. 10 is a block diagram of the entire structure of a signal electrode drive circuit according to a third embodiment of the present invention.

This third embodiment of the present invention was devised in consideration of the above problem. It monitors the voltage state of the second power voltage group and, if the second power source is turned off, it supplies the first power source to the frame memory in order to preserve the display data contained therein. A block diagram of the entire configuration of an X driver in accordance with the third embodiment is shown in FIG. 10. Structural blocks in FIG. 10 that have the same reference numbers as those in FIGS. 1 and 8 are the same as those described with reference to the first and second embodiments. In this case, a power monitoring circuit 601 is added to the configuration of the second embodiment. This power monitoring circuit 601 monitors the voltage difference between $V_{DD2}$ and $V_{SS2}$ supplied to the frame memory 109, the drive signal determination circuit 111, and the latch circuit 112 within the high-voltage-amplitude operating portion 102. It informs other devices such as an external MPU and others whether the second power source is on or off through a MONI terminal. Thus a device such as an external MPU and others can determine whether or not it is possible to transfer display data by monitoring the MONI terminal while it is sending display data to the X driver. In other words, if the second power source turns off, data write to the frame memory 109 is disabled. Thus the MONI terminal can be used to inform a device such as an external MPU of the on/off state of the power source, to prevent the external device from writing useless data to the frame memory 109, or prevent erroneous determination that data has been written when data write is, in fact, impossible.

The power monitoring circuit 601 also functions to supply the second power voltage group $V_{DD2}$ and $V_{SS2}$ to the frame memory 109 as usual when the second power source is on, or supply the first power voltage group $V_{DD}$ and $V_{SS}$ to the frame memory 109 as usual when the second power source is off. This ensures that the display data within the frame memory 109 is preserved. With a high-resistance type of RAM, this means that data read and write operations cannot be performed with the first power voltage (voltage difference 2.7 V), but it does have the advantage that data can be preserved.

Figure 11:
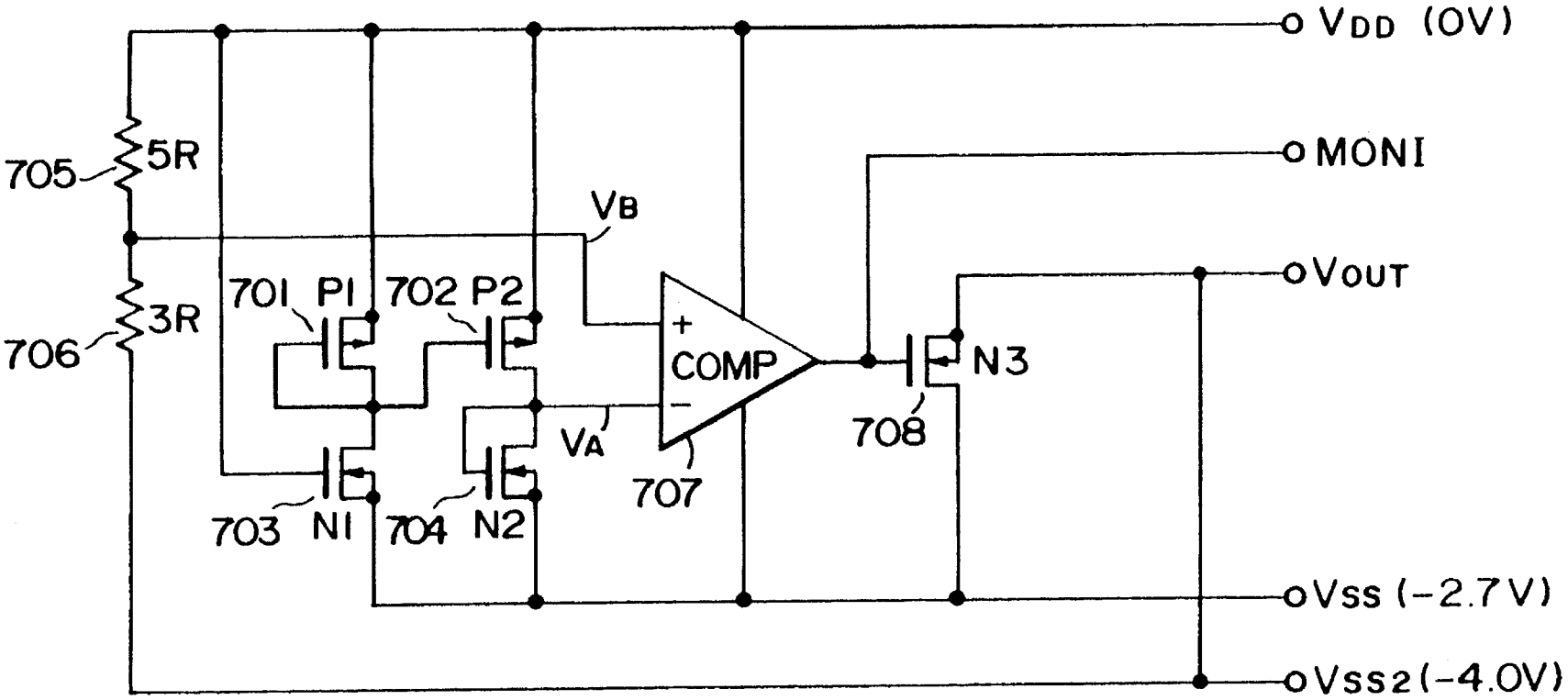
FIG. 11 is a diagram exemplifying the configuration of a power monitoring circuit.
Figure 12:
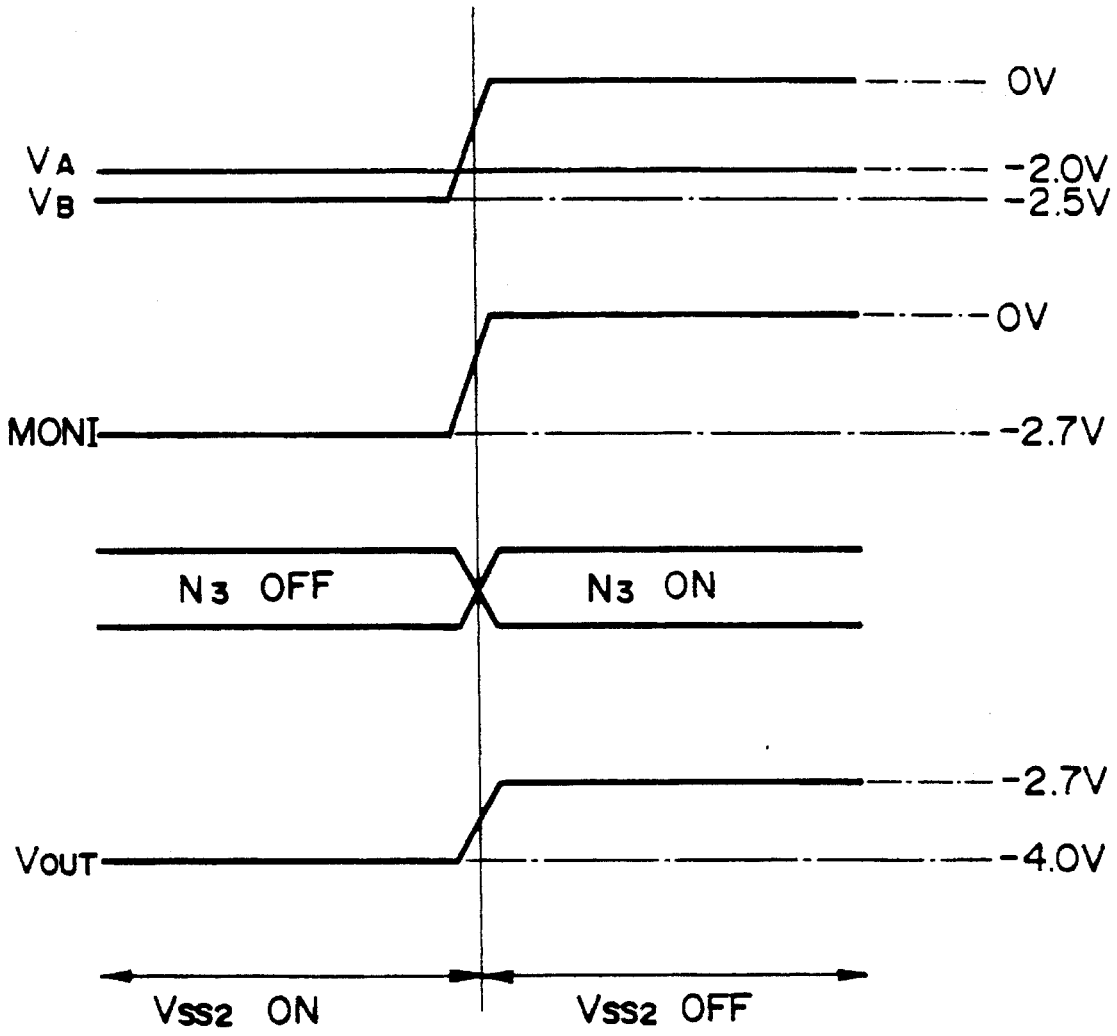
FIG. 12 is a diagram of waveforms used to illustrate the operation of the power monitoring circuit.

An example of the configuration of a power monitoring circuit 601 of this embodiment is shown in FIG. 11. This power monitoring circuit 601 comprises p-channel transistors 701 and 702 (P1 and P2), n-channel transistors 703, 704, and 708 (N1, N2, and N3), resistors 705 and 706 (5R, 3R) have a resistance ratio of 5:3, and a comparator 707 (COMP). The operation of this power monitoring circuit 601 will now be described with reference to the voltage waveform charts of FIG. 12. The portion configured of components P1, P2, N1, and N2 is a reference voltage generation section that operates in the same manner as described previously with respect to the constant-voltage circuit. This reference voltage generation section generates a voltage $V_A$ of −2.0 V and this $V_A$ is input to the inverting input terminal of the comparator 707. A voltage $V_B$ is input to the non-inverting input terminal of the comparator 707. In this embodiment, since $V_2$ and $V_{DD}$ are both equal to 0 V, when the second power source is on, a voltage difference of 4.0 V between $V_{DD}$ and $V_{SS2}$ is divided by the resistors 705 and 706 (5R and 3R) to make the voltage $V_B$ (=−2.5 V). Therefore, since $V_A$ is greater than $V_B$, as shown in FIG. 12, the output terminal MONI of the comparator 707 is at −2.7 and thus transistor N3 turns off. A terminal $V_{OUT}$ connected to the transistor N3 is also connected to $V_{SS2}$, and −4.0 V is supplied at $V_{SS2}$. Therefore, −4.0 V is output at $V_{OUT}$ when the transistor N3 is off. This means that 0 V and −4.0 V are input to the power terminals $V_{DD}$ and $V_{88}$ of the frame memory 109, respectively, ensuring normal read and write operations with respect to the frame memory 109.

The operation when the second power source is off will now be described. As should be clear from observation of the configuration of the constant-voltage circuit 401 shown in FIG. 9, the $V_{SS2}$ terminal is connected to $V_{DD}$ (which is the same as $V_2$) through the resistors 506 and 507. Therefore, the output $V_{OUT}$ of the power monitoring circuit 601 is also connected to $V_{DD}$ through the resistors 506 and 507. However, since $V_B$ (=0 V) is input to the non-inverting input of the comparator 707, the output MONI of the comparator 707 is at 0 V and thus the transistor N3 is on. This connects $V_{OUT}$ to $V_{SS}$ (=−2.7 V), and thus −2.7 V is output from $V_{OUT}$, as shown in FIG. 12. This means that 0 V and −2.7 V are input to the power terminals $V_{DD}$ and $V_{SS}$ of the frame memory 109. Therefore, although read and write operations with respect to the frame memory 109 are not possible, data can be preserved therein.

Note that the present invention is not limited to the above described embodiments. It should be obvious to those skilled in the art that other variations of the present invention can be embodied in accordance with the range of the claims stated herein.

Figure 13:
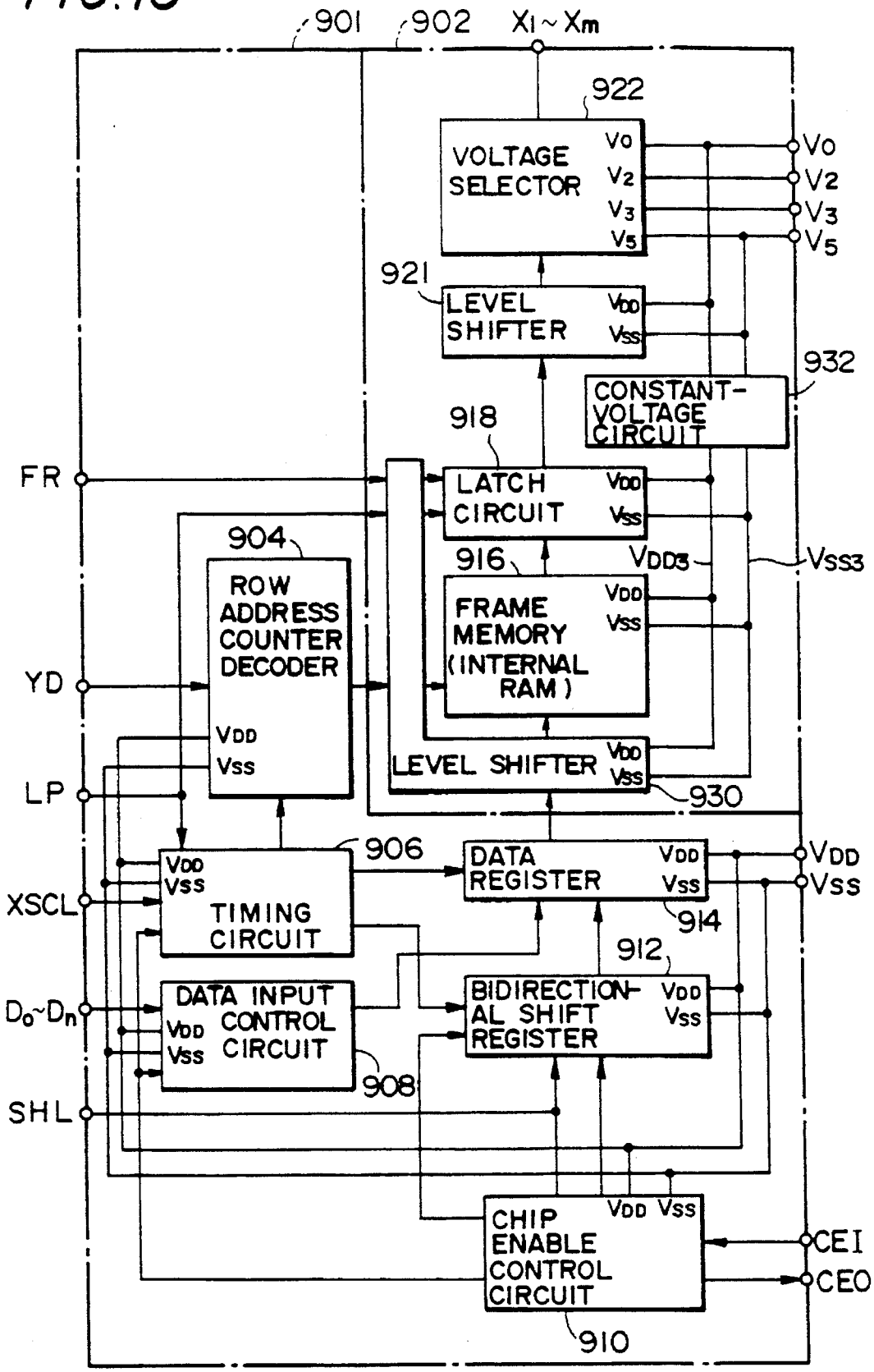
FIG. 13 is a block diagram exemplifying the configuration of the present invention when an amplitude selective addressing scheme is used.
Figure 14:
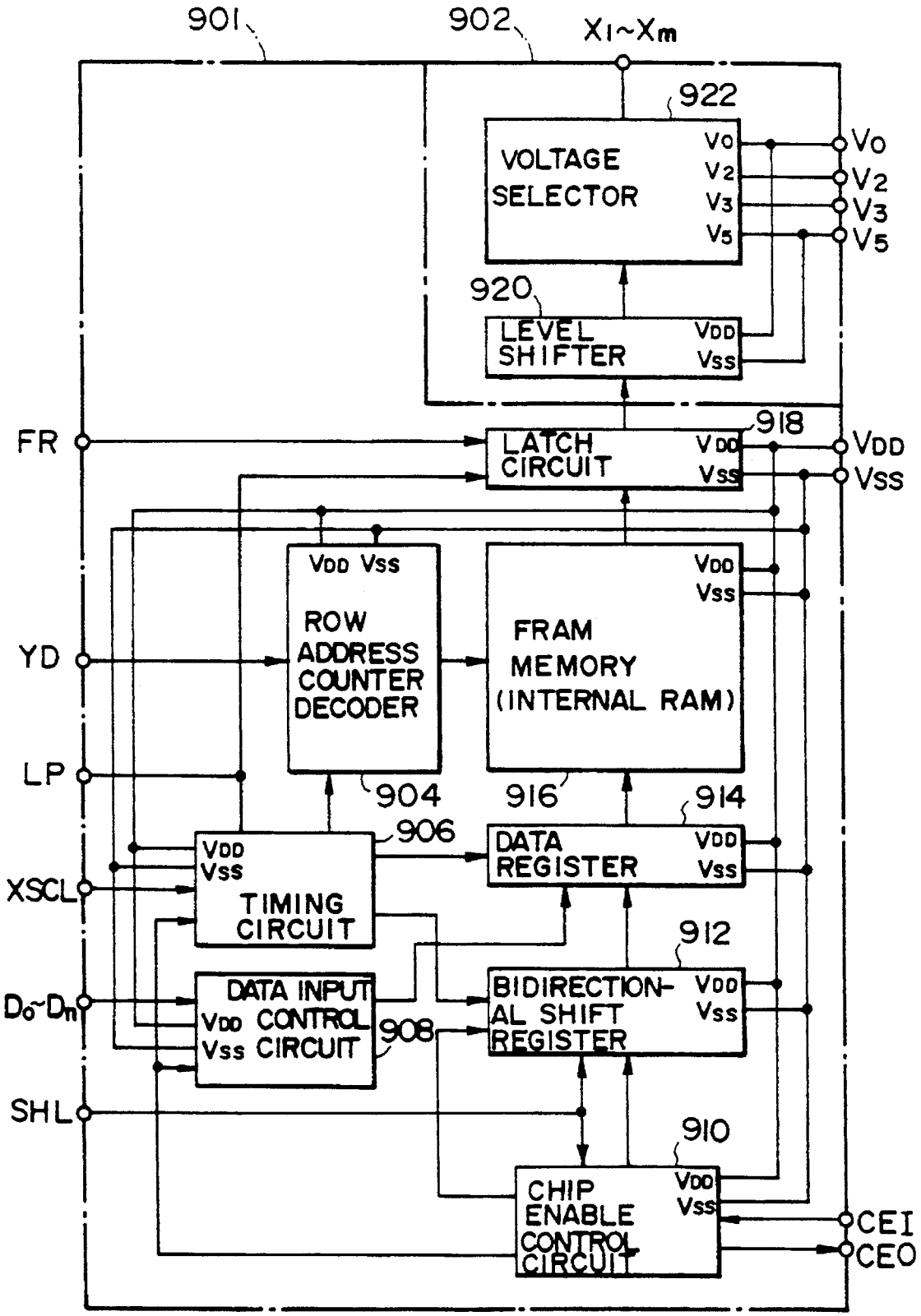
FIG. 14 is a block diagram of the entire structure of a prior art signal electrode drive circuit.

For example, the above described first to third embodiments were described with reference to an examples of X drivers that utilize a multiple line selection drive method, but the present invention is not limited thereto and can also be applied to X drivers that use an amplitude selective addressing scheme. An example of the configuration of such an X driver is shown in FIG. 13. This configuration differs from that shown in FIG. 14 in that, first of all, the frame memory 916, the latch circuit 918, and a level shifter 930 are provided in addition to a level shifter 921 and the voltage selector 922 in the high-voltage-amplitude operating portion 902, and the levels of signals from the row address counter decoder 904 and the data register 914 are converted by the level shifter 930 for input to the frame memory 916. A constant-voltage circuit 932 is also provided, to reduce the high-voltage second power voltage group to voltages $V_{DD3}$ and $V_{SS3}$ on which a RAM fabricated by a high-integration processing can operate, and these voltages are supplied to components such as the frame memory 916. The level shifter 921 is provided between the latch circuit 918 and the voltage selector 922 in order to increase the output signals from the latch circuit 918 to the levels $V_0$ to $V_5$ of the second power voltage group. In this case, the voltage difference between power voltages $V_{DD3}$ and $V_{SS3}$ supplied to the frame memory 916 is set to be less than, for example, the voltage difference between $V_0$ and $V_5$, but greater than the voltage difference between $V_{DD}$ and $V_{SS}$ supplied to the low-voltage-amplitude operating portion 901. This setting ensures that the frame memory 916 can be configured of a high-resistance type of RAM cell and also there is no need to fabricate the frame memory 916 and the latch circuit 918 by a high-withstand-voltage process (high voltage LSI process). This makes it possible to reduce the chip area and lower the power consumption of the overall device. Note, however, that the configuration of the present invention when an amplitude selective addressing scheme is used is not limited to that shown in FIG. 13. In addition, the present invention is not limited to a simple matrix type of liquid crystal display device; it can also be applied to other types of liquid crystal display device.

These embodiments have taken as an example a high-resistance type of RAM, but the present invention is not limited thereto. For example, a thin-film transistor (TFT) type of RAM that operates at lower voltages than a high-resistance type of RAM could also be used. In such a case, the lower limit of a power source voltage difference that ensures the normal operation of a RAM configured of TFTs could be made to exceed the voltage difference of the first power voltage group supplied to the low-voltage-amplitude operating portion. The present invention can also be applied to the use of other types of memory, such as SRAM, DRAM, or EEPROM, to configure the frame memory. Instead of high resistance elements, a configuration in which a depletion type of transistor is used could be considered.

What is claimed is:

1. A liquid crystal drive device comprising:

a low-voltage amplitude operating portion having at least a control logic unit and operating on the supply of a first power voltage group; and a high-voltage-amplitude operating portion operating on the supply of a second power voltage group, said second power voltage group having a voltage difference between at least one pair of power voltages included within said second power voltage group, one on a high-potential side and one on a low-potential side, said voltage difference being greater than a voltage difference between a power voltage on a high-potential side and a power voltage on a low-potential side within said first power voltage group, said second power voltage group being used to drive liquid crystal elements of a liquid crystal panel;

said liquid crystal drive device further comprising:

data storage means for storing image data for driving the liquid crystal elements of said liquid crystal panel; and means for supplying an operating power source to said data storage means, said operating power source being a voltage group that is one of said second power voltage group and a third power voltage group which is obtained by converting said second power voltage group.

2. A liquid crystal drive device according to claim 1, wherein:

said data storage means comprises a plurality of memory cells capable of being temporarily written to and read from, and each of said memory cells comprises at least one pair of transistors for holding data, with a high-resistance element connected to each of said transistors in series.

3. A liquid crystal drive device according to claim 1, further comprising:

latch means for latching image data that has been read out from said data storage means;

level-shifting means for converting the voltage levels of said latched image data; and voltage selection means for a) selecting from said second power voltage group a liquid crystal drive voltage on the basis of said image data whose voltage level has been converted, and for b) outputting said liquid crystal drive voltage to signal electrodes of said liquid crystal panel;

said latch means, said level-shifting means, and said voltage selection means being located in said high-voltage amplitude operating portion.

4. A liquid crystal drive device according to claim 1, further comprising:

drive signal determination means for determining drive voltage information for signal electrodes of said liquid crystal panel based on image data read out from said data storage means and based on the voltage states of a plurality of simultaneously selected scan electrodes of said liquid crystal panel;

latch means for latching said drive voltage information that is output from said drive signal determination means; and voltage selection means for a) selecting from said second power voltage group a liquid crystal drive voltage on the basis of said latched drive voltage information and for b) outputting said liquid crystal drive voltage to said signal electrodes;

said drive signal determination means, said latch means, and said voltage selection means being located in said high-voltage-amplitude operating portion.

5. A liquid crystal drive device according to claim 1, further comprising:

constant-voltage generation means that yields a regulated voltage from said second power voltage group, said data storage means operating on the supply of said regulated voltage.

6. A liquid crystal drive device according to claim 4, further comprising:

constant-voltage generation means that yields a regulated voltage from said second power voltage group, said data storage means operating on the supply of said regulated voltage.

7. A liquid crystal drive device according to claim 1, further comprising:

power monitoring means for monitoring the voltage state of said second power voltage group or said third power voltage group, said power monitoring means comprising switching means for switching the operating power source supplied to said data storage means from a voltage within one of said second power voltage group and said third power voltage group to a voltage within said first power voltage group.

8. A liquid crystal drive device according to claim 4, further comprising:

power monitoring means for monitoring the voltage state of said second power voltage group or said third power voltage group, said power monitoring means comprising switching means for switching the operating power source supplied to said data storage means from a voltage within one of said second power voltage group and said third power voltage group to a voltage within said first power voltage group.

9. A liquid crystal drive device according to claim 5, further comprising:

power monitoring means for monitoring the voltage state of said second power voltage group or said third power voltage group, said power monitoring means comprising switching means for switching the operating power source voltage supplied to said data storage means from a voltage within one of said second power voltage group and said third power voltage group to a voltage within said first power voltage group.

10. A liquid crystal drive device according to claim 6, further comprising:

power monitoring means for monitoring the voltage state of said second power voltage group or said third power voltage group, said power monitoring means comprising switching means for switching the operating power source voltage supplied to said data storage means from a voltage within one of said second power voltage group and said third power voltage group to a voltage within said first power voltage group.

11. A liquid crystal drive device according to claim 7, wherein said power monitoring means comprises output means for supplying a result signal indicative of the voltage state of said second power voltage group to an external device.

12. A liquid crystal drive device according to claim 7, wherein said power monitoring means comprises:

means for dividing the voltage difference existing between a pair of power voltages within one of said second power voltage group and said third power voltage group, one of said pair of power voltages being on a high-potential side and the other of said pair of power voltages being on a low-potential side, to generate a divided voltage;

comparison means for comparing said divided voltage with a reference voltage selected from said first power voltage group to yield a comparison result; and switching means for a) performing an on/off operation on the basis of said comparison result and for b) switching the power voltage supplied to said data storage means from a voltage within one of said second power voltage group and said third power voltage group to a voltage within said first power voltage group.

13. A liquid crystal drive device according to claim 8, wherein said power monitoring means comprises:

means for dividing the voltage difference existing between a pair of power voltages within one of said second power voltage group and said third power voltage group, one of said pair of power voltages being on a high-potential side and the other of said pair of power voltages being on a low-potential side, to generate a divided voltage;

comparison means for comparing said divided voltage with a reference voltage selected from said first power voltage group to yield a comparison result; and switching means for a) performing an on/off operation on the basis of said comparison result and for b) switching the power voltage supplied to said data storage means from a voltage within one of said second power voltage group and said third power voltage group to a voltage within said first power voltage group.

14. A liquid crystal drive device according to claim 9, wherein said power monitoring means comprises:

means for dividing the voltage difference existing between a pair of power voltages within one of said second power voltage group and said third power voltage group, one of said pair of power voltages being on a high-potential side and the other of said pair of power voltages being on a low-potential side, to generate a divided voltage;

comparison means for comparing said divided voltage with a reference voltage selected from said first power voltage group to yield a comparison result; and switching means for a) performing an on/off operation on the basis of said comparison result and for b) switching the power voltage supplied to said data storage means from a voltage within one of said second power voltage group and said third power voltage group to a voltage within said first power voltage group.

15. A liquid crystal drive device according to claim 10, wherein said power monitoring means comprises:

means for dividing the voltage difference existing between a pair of power voltages within one of said second power voltage group and said third power voltage group, one of said pair of power voltages being on a high-potential side and the other of said pair of power voltages being on a low-potential side, to generate a divided voltage;

comparison means for comparing said divided voltage with a reference voltage selected from said first power voltage group to yield a comparison result; and switching means for a) performing an on/off operation on the basis of said comparison result and for b) switching the power voltage supplied to said data storage means from a voltage within one of said second power voltage group and said third power voltage group to a voltage within said first power voltage group.

16. A liquid crystal display device comprising at least the liquid crystal drive device of claim 1 and a liquid crystal panel in which liquid crystal elements are arranged in matrix form.

17. A liquid crystal display device comprising at least the liquid crystal drive device of claim 4 and a liquid crystal panel in which liquid crystal elements are arranged in matrix form.

18. A liquid crystal display device comprising at least the liquid crystal drive device of claim 5 and a liquid crystal panel in which liquid crystal elements are arranged in matrix form.

19. A liquid crystal display device comprising at least the liquid crystal drive device of claim 7 and a liquid crystal panel in which liquid crystal elements are arranged in matrix form.

20. A liquid crystal drive method used in a liquid crystal drive device, said liquid crystal drive device comprising a low-voltage-amplitude operating portion having at least a control logic unit and operating on the supply of a first power voltage group, said liquid crystal drive device further comprising a high-voltage-amplitude operating portion operating on the supply of a second power voltage group, said second power voltage group being used to drive liquid crystal elements arranged in matrix form on a liquid crystal panel, said method comprising:

setting a voltage difference between at least one pair of power voltages included within said second power voltage group, one on a high-potential side and one on a low-potential side, to be greater than a voltage difference between a power voltage on a high-potential side and a power voltage on a low-potential side within said first power voltage group;

storing data for driving the liquid crystal elements of said liquid crystal panel in a data storage means; and supplying an operating power source to said data storage means, said operating power source being a voltage group that is one of said second power voltage group and a third power voltage group which is obtained by converting said second power voltage group.

21. A liquid crystal device, comprising:

a liquid crystal panel having a plurality of scan electrodes, a plurality of signal electrodes intersecting said scan electrodes, and a plurality of liquid crystal elements arranged in matrix form; and a drive device for driving said liquid crystal panel, said drive device comprising:

a first circuit portion operating on the supply of a first power voltage group and including a control circuit;

a second circuit portion operating on the supply of a second voltage group and including a voltage selector;

data storage means for storing data controlled by said control circuit, said voltage selector selecting a drive voltage that is applied to said signal electrodes based on said stored data; and power supplying means for supplying an operating power source to said data storage means, said operating power source being a voltage group that is one of said second power voltage group and a third power voltage group which is obtained by converting said second power voltage group, a voltage difference between a power voltage on a high-potential side and a power voltage on a low-potential side within said second power voltage group being greater than a voltage difference between a power voltage on a high-potential side and a low-potential side within said first power voltage group.

22. The liquid crystal device according to claim 21, wherein said control circuit is a data input circuit.

23. The liquid crystal device according to claim 21, wherein said control circuit is a timing circuit.

24. The liquid crystal device according to claim 21, wherein said control circuit is an address register of said data storage means.

25. The liquid crystal device according to claim 21, wherein said control circuit is an input register for storing said data.

26. A liquid crystal device according to claim 21, wherein:

said data storage means comprises a plurality of memory cells capable of being temporarily written to and read from, each of said memory cells comprising at least one pair of transistors for holding data with a high-resistance element connected to each of said transistors in series.

27. A liquid crystal device according to claim 21, wherein said drive device further comprises:

latch means for latching data that has been read out from said data storage means;

level-shifting means for converting the voltage levels of said latched data; and voltage selection means for a) selecting from said second power voltage group a liquid crystal drive voltage on the basis of said data whose voltage level has been converted, and for b) outputting said liquid crystal drive voltage to signal electrodes of said liquid crystal panel;

said latch means, said level-shifting means, and said voltage selection means being located in said second circuit portion.

28. A liquid crystal device according to claim 21, wherein said drive device further comprises:

drive signal determination means for determining drive voltage information for said signal electrodes based on data read out from said data storage means and based on the voltage states of a plurality of simultaneously selected scan electrodes;

latch means for latching said drive voltage information that is output from said drive signal determination means; and voltage selection means for a) selecting from said second power voltage group a liquid crystal drive voltage on the basis of said latched drive voltage information and for b) outputting said liquid crystal drive voltage to signal electrodes of said liquid crystal panel;

said drive signal determination means, said latch means, and said voltage selection means being located in said second circuit portion.

29. A liquid crystal device according to claim 21, wherein said drive device further comprises:

constant-voltage generation means that yields a regulated voltage from said second power voltage group, said data storage means operating on the supply of said regulated voltage.

30. A liquid crystal device according to claim 28, wherein said drive device further comprises:

constant-voltage generation means that yields a regulated voltage from said second power voltage group, said data storage means operating on the supply of said regulated voltage.

31. A liquid crystal device according to claim 21, wherein said drive device further comprises:

power monitoring means for monitoring the voltage state of one of said second power voltage group and said third power voltage group, said power monitoring means comprising switching means for switching the operating power source supplied to said data storage means from a voltage within one of said second power voltage group and said third power voltage group to a voltage within said first power voltage group.

32. A liquid crystal device according to claim 28, wherein said drive device further comprises:

power monitoring means for monitoring the voltage state of one of said second power voltage group and said third power voltage group, said power monitoring means comprising switching means for switching the operating power source supplied to said data storage means from a voltage within one of said second power voltage group and said third power voltage group to a voltage within said first power voltage group.

33. A liquid crystal device according to claim 29, wherein said drive device further comprises:

power monitoring means for monitoring the voltage state of one of said second power voltage group and said third power voltage group, said power monitoring means comprising switching means for switching the operating power voltage supplied to said data storage means from a voltage within one of said second power voltage group and said third power voltage group to a voltage within said first power voltage group.

34. A liquid crystal device according to claim 30, wherein said drive device further comprises:

power monitoring means for monitoring the voltage state of one of said second power voltage group and said third power voltage group, said power monitoring means comprising switching means for switching the operating power voltage supplied to said data storage means from a voltage within one of said second and said third power voltage group to a voltage within said first power voltage group.

35. A liquid crystal device according to claim 31, wherein:

said power monitoring means comprises output means for supplying a result signal indicative of the voltage state of said second power voltage group to an external device.

36. A liquid crystal device according to claim 31, wherein said power monitoring means comprises:

means for dividing the voltage difference existing between a pair of power voltages within one of said second power voltage group and said third power voltage group, one of said pair of power voltages being on a high-potential side and the other of said pair of power voltages being on low-potential side, to generate a divided voltage;

comparison means for comparing said divided voltage with a reference voltage selected from said first power voltage group to yield a comparison result; and switching means for a) performing an on/off operation on the basis of said comparison result and for b) switching the power voltage supplied to said data storage means from a voltage within one of said second power voltage group and said third power voltage group to a voltage within said first power voltage group.

37. A liquid crystal device according to claim 32, wherein said power monitoring means comprises:

means for dividing the voltage difference existing between a pair of power voltages within one of said second power voltage group and said third power voltage group, one of said pair of power voltages being on a high-potential side and the other of said pair of power voltages being on a low-potential side, to generate a divided voltage;

comparison means for comparing said divided voltage with a reference voltage selected from said first power voltage group to yield a comparison result; and switching means for a) performing an on/off operation on the basis of said comparison result and for b) switching the power voltage supplied to said data storage means from a voltage within one of said second power voltage group and said third power voltage group to a voltage within said first power voltage group.

38. A liquid crystal device according to claim 33, wherein said power monitoring means comprises:

means for dividing the voltage difference existing between a pair of power voltages within one of said second power voltage group and said third power voltage group, one of said pair of power voltages being on a high-potential side and the other of said pair of power voltages being on a low-potential side, to generate a divided voltage;

comparison means for comparing said divided voltage with a reference voltage selected from said first power voltage group to yield a comparison result; and switching means for a) performing an on/off operation on the basis of said comparison result and for b) switching the power voltage supplied to said data storage means from a voltage within one of said second power voltage group and said third power voltage group to a voltage within said first power voltage group.

39. A liquid crystal device according to claim 34, wherein said power monitoring means comprises:

means for dividing the voltage difference existing between a pair of power voltages within one of said second power voltage group and said third power voltage group, one of said pair of power voltages being on a high-potential side and the other of said pair of power voltages being on a low-potential side, to generate a divided voltage;

comparison means for comparing said divided voltage with a reference voltage selected from said first power voltage group to yield a comparison result; and switching means for a) performing an on/off operation on the basis of said comparison result and for b) switching the power voltage supplied to said data storage means from a voltage within one of said second power voltage group and said third power voltage group to a voltage within said first power voltage group.

* * * * *